US007862157B2

(12) United States Patent
Fukui et al.

(10) Patent No.: US 7,862,157 B2
(45) Date of Patent: Jan. 4, 2011

(54) INK JET RECORDING HEAD

(75) Inventors: Shigeki Fukui, Kawasaki (JP); Ken Ikegame, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 290 days.

(21) Appl. No.: 12/166,538

(22) Filed: Jul. 2, 2008

(65) Prior Publication Data

US 2009/0015639 A1 Jan. 15, 2009

(30) Foreign Application Priority Data

Jul. 2, 2007 (JP) ..... 2007-174295

(51) Int. Cl.
*B41J 2/05* (2006.01)
*B41J 29/38* (2006.01)

(52) U.S. Cl. ..... 347/62; 347/14; 347/60

(58) Field of Classification Search ..... 347/60–62
See application file for complete search history.

(56) References Cited

U.S. PATENT DOCUMENTS

| | | | |
|---|---|---|---|
| 5,191,360 | A | 3/1993 | Pohlig |
| 6,315,396 | B1 | 11/2001 | Ozaki et al. |
| 6,457,794 | B1 | 10/2002 | Tajika et al. |

FOREIGN PATENT DOCUMENTS

| | | |
|---|---|---|
| JP | 3-5151 | 1/1991 |
| JP | 4-506481 | 11/1992 |
| JP | 5-31905 | 2/1993 |
| JP | 10-774 | 1/1998 |
| JP | 10-776 | 1/1998 |

*Primary Examiner*—Matthew Luu
*Assistant Examiner*—Lisa M Solomon
(74) *Attorney, Agent, or Firm*—Fitzpatrick, Cella, Harper & Scinto

(57) ABSTRACT

An ink jet recording head includes ejection resistors for generating thermal energy for ejecting ink; warming resistors for generating thermal energy for heating the ink; ejection outlets, provided correspondingly to the ejection resistors, for ejecting the ink; and a recording element substrate provided with ink flow paths provided correspondingly to and for supplying the ink to the ejection outlets, the ejection resistors, the warming resistors, a first ejection outlet array portion including the ejection outlets, and a second ejection outlet array portion including the ejection outlets. An amount of one ink droplet to be ejected from an ejection outlet of the first ejection outlet array portion is different from that from an ejection outlet of the second ejection outlet array portion. The warming resistors are formed above the recording element substrate through the ejection resistors and an insulating layer with respect to a lamination direction of the recording element substrate and are disposed between the ejection resistors and the ink flow paths. The warming resistors include a first warming resistor disposed at the first ejection outlet array portion with a larger ejection amount and a second warming heat generating resistor disposed at the second ejection outlet array portion with a smaller ejection amount.

10 Claims, 20 Drawing Sheets

INK JET RECORDING HEAD

FIELD OF THE INVENTION AND RELATED ART

The present invention relates to an ink jet recording head in which a traveling droplet is produced by ejection of ink to effect recording. Particularly, the present invention relates to the ink jet recording head in which an ejection heat generating resistor for ejecting the ink in a state in which the ink is heated by a warming heat generating resistor is driven.

An ink jet recording head of a thermal type effects recording by applying driving energy to an ejection heat generating resistor to cause film boiling of ink, so that an ink droplet is ejected from an ejection outlet by energy generated by the film boiling. Generally, ink used in the ink jet recording head is lowered in viscosity with an increasing ink temperature. For that reason, even in the case where a certain amount of driving energy is applied to the ejection heat generating resistor, a bubble generation state of the ink varies depending on a head temperature of the ink jet recording head or the ink temperature of the ink, so that an ejection amount is changed. In the case where the head temperature of the ink jet recording head is low, particularly with respect to an ejection characteristic of first ejection from a state in which the ink is not ejected for some time, the ejection amount can be very small. On the other hand, in the case where the head temperature of the ink jet recording head is increased due to an increase in ambient temperature or continuous use of the ink jet recording head, the ink ejection amount can be increased or a bubble generation state can be unstable. These states are present in mixture during a recording operation, so that a color density or a color tone of an image to be recorded on a recording material (medium) is changed to lower an image quality.

In order to avoid such a lowering in image quality, various methods have being employed. Japanese Laid-Open Patent Application (JP-A) Hei 5-31905 discloses a constitution in which a head temperature of an ink jet recording head is detected by providing a head temperature detecting element (head temperature sensor) in a semiconductor element (recording element substrate) of the ink jet recording head. In this constitution, such a method that a waveform of a driving pulse when an ejection heat generating resistor is driven is adjusted is employed.

JP-A Hei 3-5151 discloses a constitution in which a warming heat generating resistor for heating an ink jet recording head is provided in the same layer as an ejection heat generating resistor on a recording element substrate. Pre-heating of ink is performed by driving this warming heat generating resistor to obviate deterioration of an ejection characteristic of the ink jet recording head at low temperatures.

JP-A Hei 10-774 discloses a constitution in which a warming heat generating resistor is formed on a side where an ink flow path is not formed with respect to an ejection heat generating resistor-formed layer on a substrate (i.e., a substrate lower layer). JP-A Hei 10-774 also discloses a method of preventing more-than-necessary increase in size of a recording element substrate and a method of preventing an increase in production steps, by using layers used for an IC circuit.

Further, countermeasures to difficulty of ink supply to a portion of an ejection heat generating resistor after the ink is ejected, e.g., in the case of a low head temperature of an ink jet recording head are disclosed in JP-A Hei 4-506481. More specifically, JP-A Hei 4-506481 discloses a constitution in which a warming heat generating resistor is formed on a substrate upper layer of an ejection heat generating resistor and at a common chamber portion to facilitate ink flow to a portion of the ejection heat generating resistor.

In recent years, the ink jet recording head is increased in density and resolution, so that ink jet recording heads using very small ink droplets are proposed.

Of these ink jet recording heads, from the viewpoints of necessity to record images of various types and a recording speed, such an ink jet recording head that ink droplets of the same ink are ejected from the same ink jet recording head in a plurality of ink ejection amounts is also proposed. Even in the case of different ejection amounts, when a common ink is used, the ink is frequently supplied from a single ink supply port with such a structure.

As a method of decreasing the ejection amount, a method of decreasing an ejection outlet diameter or a size of an ink flow path and a method of decreasing an amount of heat generation of the ejection heat generating resistor have been generally performed. When the ejection outlet diameter is small, ink from the neighborhood of the ejection outlet is liable to be affected by the influence of an increase in viscosity of the ink due to vaporization of water content from the ejection outlet. Further, by a change in the ink, a color density or a color tone of an image to be recorded on a recording medium (material) is changed, so that a lowering in image quality such as an occurrence of streak, non-uniformity, or the like can occur. In order to prevent the lowering in image quality, it is necessary to heat the ink in advance thereby to lower the ink viscosity.

However, such a conventional ink jet recording head is accompanied with the following problem.

When the entire recording element substrate is heated, a temperature of the entire recording element substrate is increased regardless of a difference in ejection amount. That is, when the recording element substrate is heated correspondingly to a relatively small ejection amount, an ejection amount of a portion with a relatively large ejection amount is excessively large, so that ejection of the ink is unstable. Further, when the recording element substrate is heated correspondingly to the relatively large ejection amount, a characteristic of first ejection of the ink with the relatively small ejection amount occurs.

Further, a common liquid chamber for supplying ink to each ink flow path is formed on an opposite side from the ejection outlet with respect to the ink flow path, i.e., on a rear (back) side of the ink flow path, so that when the common liquid chamber portion is heated, the ink itself on the rear side of the ink flow path is decreased in resistance. For that reason, in the case where only the common liquid chamber portion is heated when compared with the case of heating the entire recording element substrate the same ejection amount cannot be obtained unless a higher driving energy is provided by the ejection heat generating resistor.

When the ink jet recording head is heated, it can be considered that a method in which a driving pulse to the extent that ink does not cause bubble generation is supplied to the ejection heat generating resistor is employed. However, in that case, a lowering in recording speed and an increase in production cost due to complicated pulse control and a lowering in recording speed due to an increased time required for increasing a head temperature of the ink jet recording head are caused to occur. Further, in the case where temperature control is made during a recording operation, the recording speed is lowered.

In the case where a warming heat generating resistor is provided in the same plane as an ejection heat generating resistor in a conventional ink jet recording head, it is necessary to dispose wiring for driving each of resistors, so that a recording element substrate is increased in size, thus resulting in an increase in production cost.

Further, in the case where the warming heat generating resistor is formed as a substrate lower layer of the ejection heat generating resistor, a material used for the ejection heat generating resistor is formed in a thin layer, so that a stepped portion of an underlying layer is required to be eliminated. For that reason, it is necessary to perform a flattening step of flattening a thin film of an insulating layer formed after the warming heat generating resistor is formed.

SUMMARY OF THE INVENTION

A principal object of the present invention is to provide an ink jet recording head with a plurality of ejection amounts capable of suppressing a lowering in ejection characteristic of first ejection and a lowering in image quality due to a change in color density or color tone, thus being capable of stably realizing ejection amounts from various ejection outlets for ejecting ink with different ejection amounts.

According to an aspect of the present invention, there is provided an ink jet recording head comprising:

a plurality of ejection heat generating resistors for generating thermal energy for ejecting ink;

a plurality of warming heat generating resistors for generating thermal energy for heating the ink;

a plurality of ejection outlets, provided correspondingly to the plurality of ejection heat generating resistors, for ejecting the ink; and a recording element substrate provided with a plurality of ink flow paths provided correspondingly to the plurality of ejection outlets to supply the ink to the plurality of ejection outlets, the plurality of ejection heat generating resistors, the plurality of warming heat generating resistors, a first ejection outlet array portion including a plurality of the ejection outlets, and a second ejection outlet array portion including a plurality of the ejection outlets, wherein an amount of one ink droplet to be ejected from an ejection outlet of the first ejection outlet array portion is different from an amount of one ink droplet to be ejected from an ejection outlet of the second ejection outlet array portion, wherein the plurality of warming heat generating resistors is formed above the recording element substrate through the plurality of ejection heat generating resistors and an insulating layer with respect to a lamination direction of layers constituting the recording element substrate and is disposed between the plurality of ejection heat generating resistors and the plurality of ink flow paths, and wherein the plurality of warming heat generating resistors comprises a first warming heat generating resistor disposed at the first ejection outlet array portion with a larger ejection amount and a second warming heat generating resistor disposed at the second ejection outlet array portion with a smaller ejection amount.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The present invention relates to a forming position of a warming heat generating resistor and a control method of the warming heat generating resistor in an ink jet recording head which comprises ink flow path portions each including ejection heat generating resistors and warming heat generating resistors and provides a plurality of ink ejection amounts.

The description will be made referring the accompanying drawings as to embodiments of the present invention.

The values given in the following embodiments are examples, and the present invention is not limited to these values. In addition, the present invention is not limited to the embodiments.

First Embodiment

The description will be made about a basic structure of an ink jet recording head cartridge according to an embodiment of the present invention.

In an ink jet recording head of the present embodiment, a recording head portion is an ink jet recording head of the type wherein a recording operation is formed by using an electrothermal transducer element for generating a thermal energy by creating a film boiling in the ink in response to an electric signal.

Figure 1:
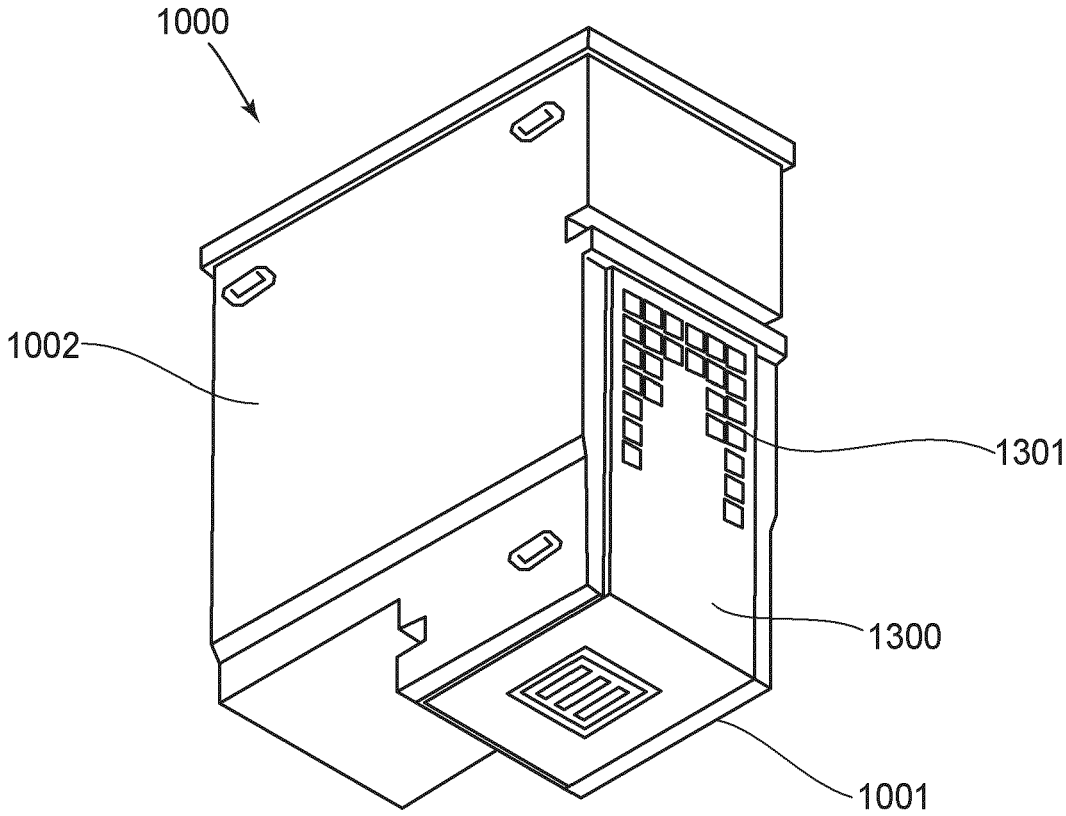
FIG. 1 is a perspective view of an ink jet cartridge of a first embodiment according to the present invention.

FIG. 1 is a perspective view of a recording head cartridge according to the embodiment of the present invention, wherein a recording head portion 1001 has a recording element substrate 1100 for ejecting an ink droplet by the action of the film boiling by heating the ink by an electrothermal transducer element which has a heat generating resistor. It comprises an electrical wiring substrate 1300 for applying the driving signal from a main assembly of a recording apparatus to the recording element substrate 1100, and a supporting member 1500 which is provided with an ink flow path for supplying the ink to the recording element substrate 1100 and which is connected with an ink container portion 1002.

Figure 2:
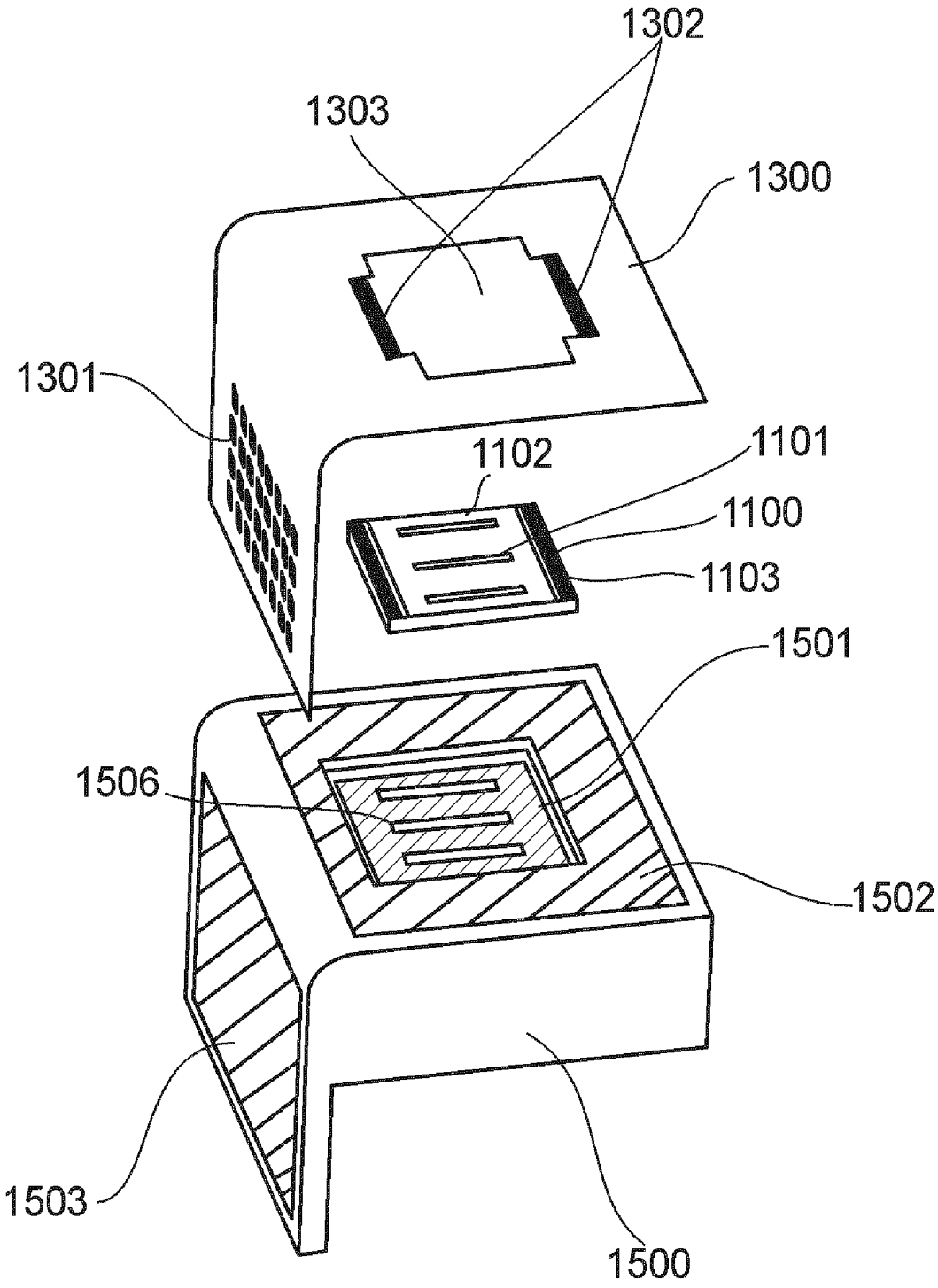
FIG. 2 is an exploded perspective view of a recording head portion according to the first embodiment of the present invention.

FIG. 2 is an exploded perspective view of the recording head portion 1001.

As shown in FIG. 2, on a major surface of the recording element substrate 1100, a nozzle plate 1102 provided with the ejection outlets 1101 and an electrode portion 1103 are provided. An opening 1303 of the electrical wiring substrate 1300 has a configuration for receiving them, and it is fixed by a first adhesive material 1501 so that an ink supply port of the recording element substrate 1100 corresponds to an ink supply port 1506 which is an exit of a flow path on the supporting member 1500. The electrical wiring substrate 1300 is fixed to a supporting member 1500 by a second adhesive material 1502 in a position where the electrode portion 1103 of an inner lead 1302 and a recording element substrate disposed at the opening 1303 can be connected with each other. The inner lead 1302 and the electrode portion 1103 are electrically connected with each other by TAB implementation technique disclosed in JP-A Hei 10-000776, for example. In the electrical wiring substrate 1300, a portion which has an external signal input terminal 1301 for inputting the driving signal from the ink jet recording apparatus is bonded to a side surface of the supporting member 1500 by a third adhesive material 1503.

Figure 3:
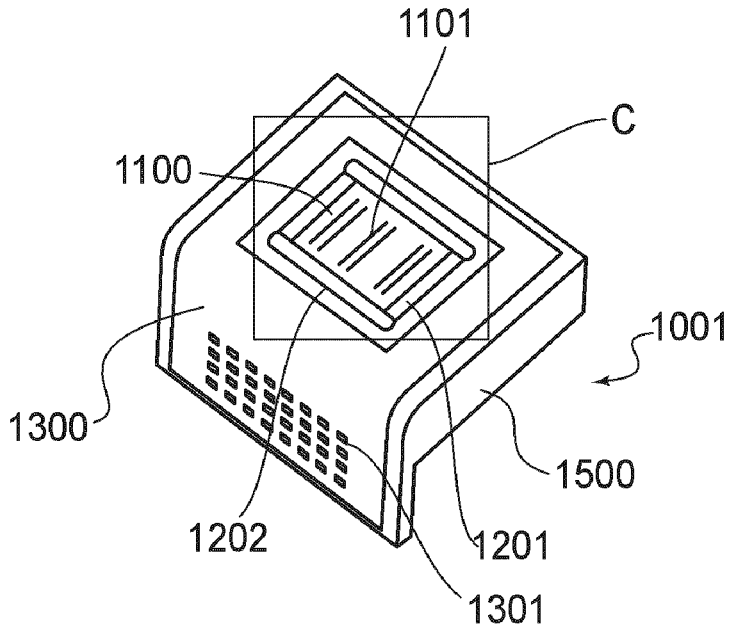
FIG. 3 is a perspective view of the recording head portion according to the first embodiment of the present invention.
Figure 4:
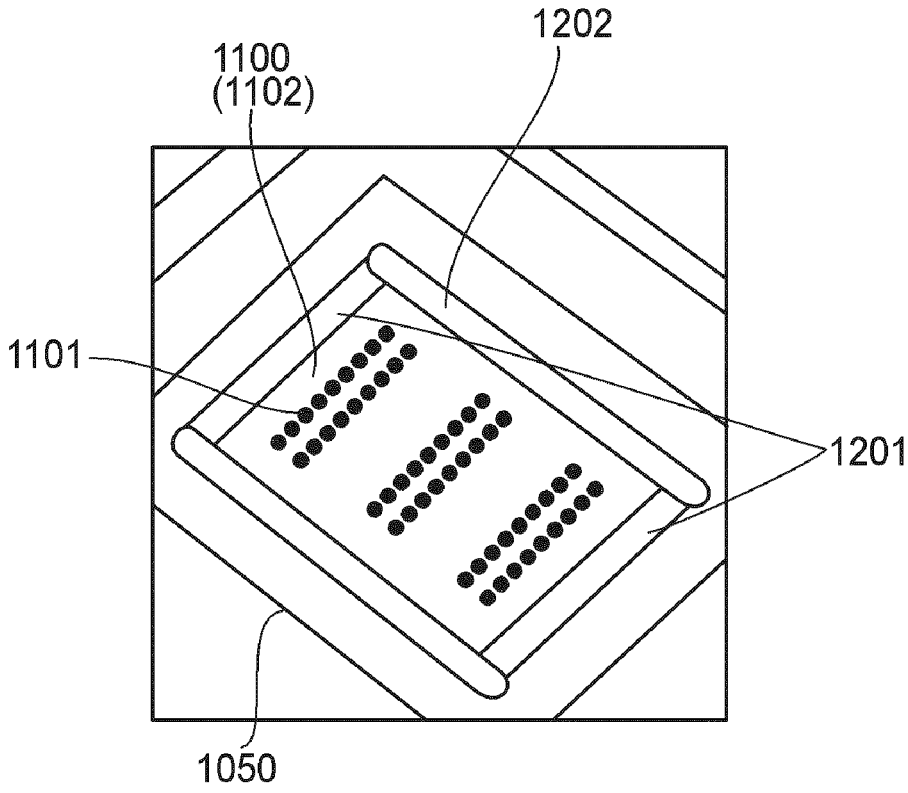
FIG. 4 is an enlarged view of a C portion shown in the FIG. 3.

FIG. 3 and FIG. 4 are perspective views of the recording head portion 1001, wherein FIG. 3A is a general arrangement and FIG. 4 is an enlarged view of the C portion shown in FIG. 3. As shown in these figures, the circumference of a side surface of the recording element substrate 1100 is sealed with the first sealant 1201, and an electrical connecting portion is sealed with the second sealant 1202, by which the electrical connecting portion is protected from corrosion by the ink and from an external force.

Figure 6:
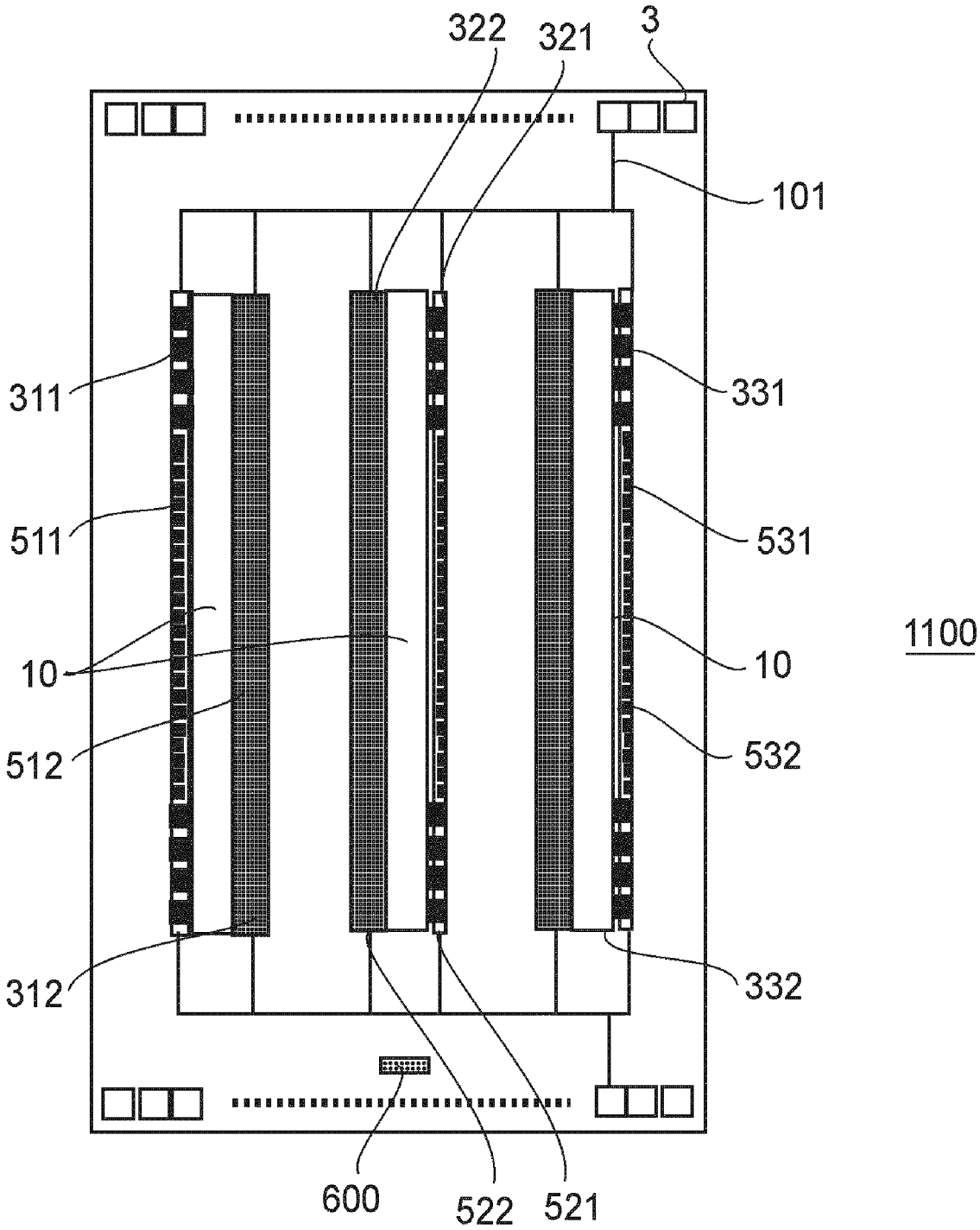
FIG. 6 is a plan view for illustrating a recording element substrate according to the first embodiment of the present invention.
Figure 7:
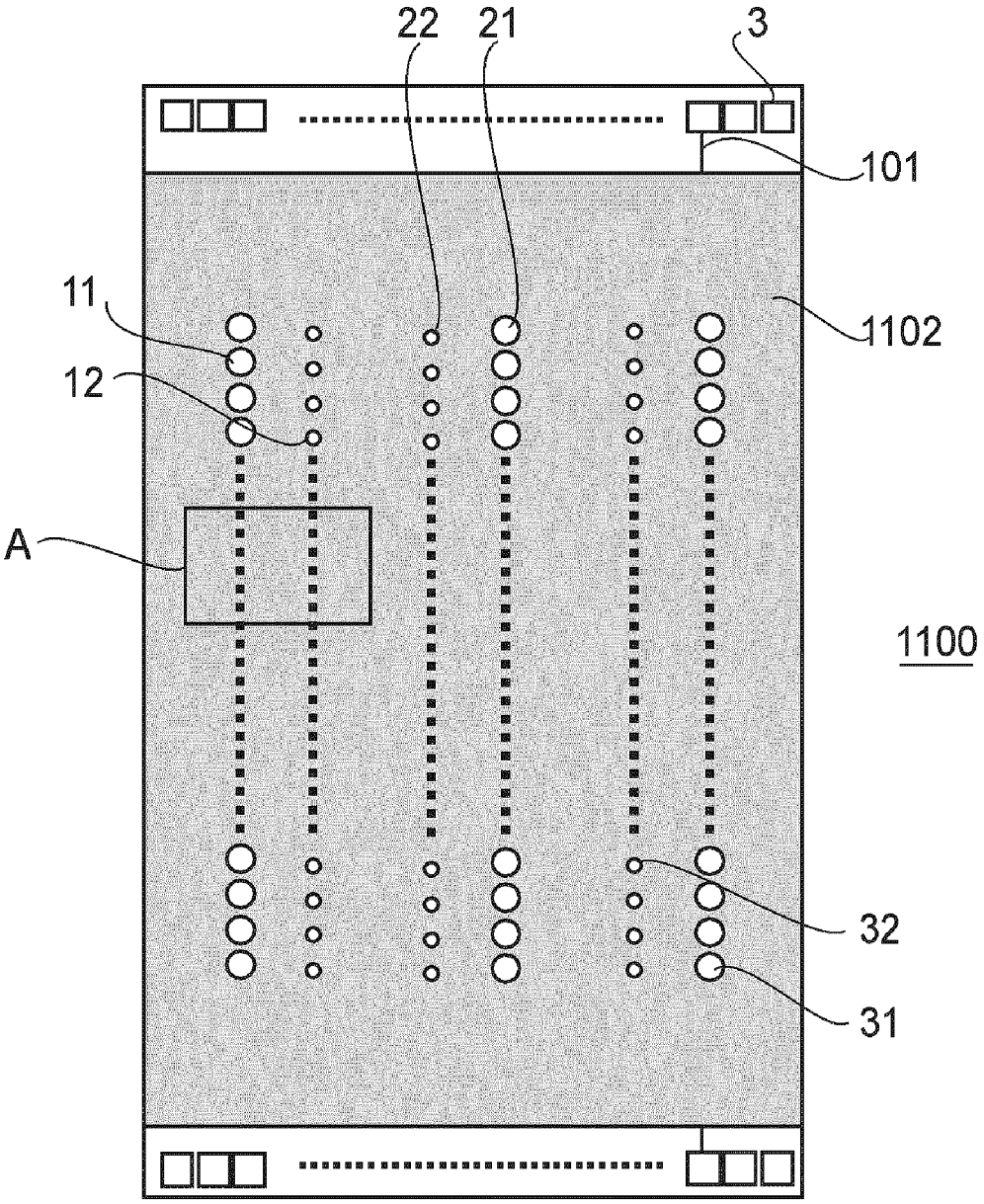
FIG. 7 is a plan view of an ink jet recording head according to the first embodiment of the present invention.
Figure 8:
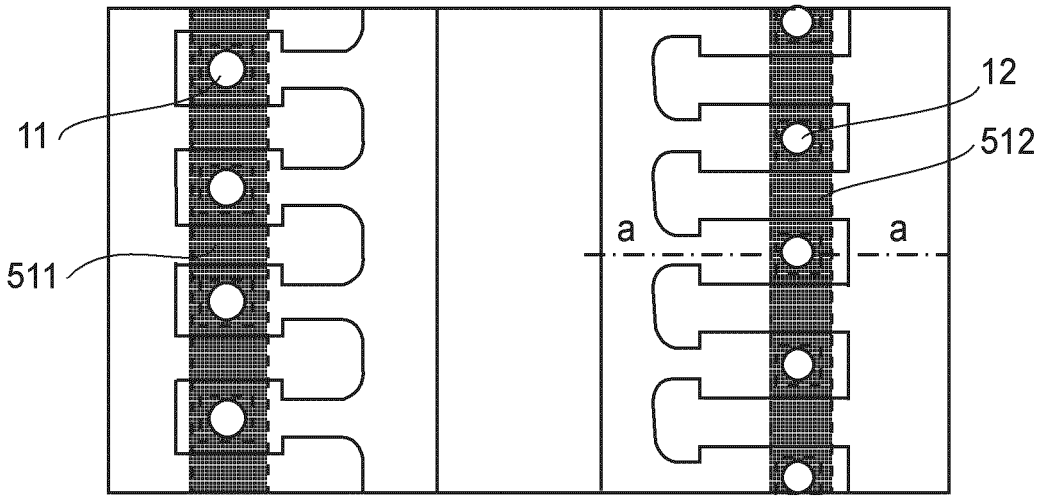
FIG. 8 is a partially plan view of the ink jet recording head according to the first embodiment of the present invention.
Figure 9:
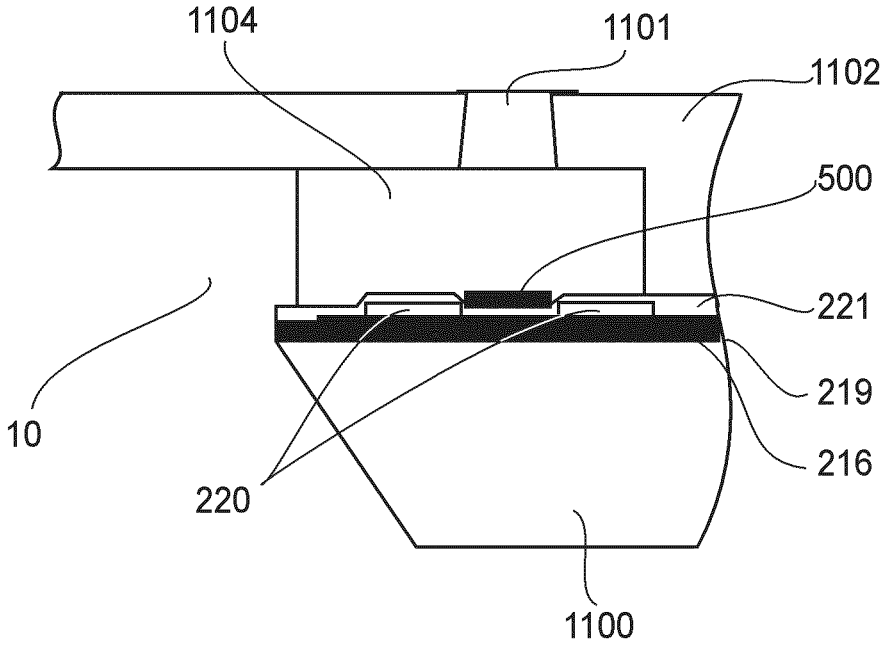
FIG. 9 is a partially sectional view of the ink jet recording head according to the first embodiment of the present invention.

FIG. 6 is a schematic plan view showing the recording element substrate provided to the ink jet recording head of this embodiment. FIG. 7 is a schematic plan view of the ink jet recording head in which ink flow paths are formed in the recording element substrate. FIGS. 8 and 9 are schematic enlarged views each showing a principal portion of the ink jet recording head.

As shown in FIGS. 6 and 7, the ink jet recording head is provided with the recording element substrate 1100 for ejecting an ink droplet from an ejection outlet by a pressure through the ink film boiling caused by applying driving energy to the ejection heat generating resistor. The recording element substrate 1100 includes, as shown in FIG. 6, a plurality of warming heat generating resistors for generating thermal energy for heating the ink. The recording element substrate 1100 further includes a head temperature sensor 600 for measuring a head temperature of the recording element substrate 1100 and wiring 101 for transmitting a driving signal to the warming heat generating resistors. Further, the recording element substrate 1100 includes electrical connecting terminals 3 for electrically connecting the recording element substrate 1100 and the electrical wiring substrate 1300 and includes ink supply ports 10 to which the ink is to be supplied. On the recording element substrate 1100, as shown in FIG. 9, the ejection outlet 1101 and the nozzle plate 1102 provided with the ejection outlet 1101 are provided.

As shown in FIG. 7, the recording element substrate 1100 is provided with first ejection outlet arrays 11, 21 and 31 providing a relatively large ejection amount and second ejection outlet arrays 12, 22 and 32 providing a relatively small ejection amount. The ejection outlet arrays 11 and 12 are used for ejecting cyan ink, the ejection outlet arrays 21 and 22 are used for ejecting magenta ink, and the ejection outlet arrays 31 and 32 are used for ejecting yellow ink. The ink supply port 10 is common to the ejection outlet arrays for the same color. Further, in correspondence with each of the ejection outlet arrays, as shown in FIG. 6, first ejection heat generating resistor arrays 311, 321 and 331 and second ejection heat generating resistor arrays 312, 322 and 332 are provided, respectively.

In this embodiment, an ejection outlet diameter of the ejection outlets with the large ejection amount is about 17 μm and the ink ejection amount is about 2 pl.

Further, as shown in FIGS. 6 and 8, first warming heat generating resistors 511, 521 and 531 are provided above and over the first ejection heat generating resistor arrays 311, 321 and 331, respectively. Further, second warming heat generating resistors 512, 522 and 532 are provided above and over the second ejection heat generating resistor arrays 312, 322 and 332, respectively. These first warming heat generating resistors 511, 521 and 531 and second warming heat generating resistors 512, 522 and 532 are formed by the same wiring.

A part of these first warming heat generating resistors 511, 521 and 531 is laminated on the recording element substrates 1100 so that it is formed between an ink flow path 1104 and the first ejection heat generating resistor arrays 311, 321 and 331. Similarly, a part of the second warming heat generating resistors 512, 522 and 532 is laminated on the recording element substrata 1100 so that it is formed between an ink flow path 1104 and the second ejection heat generating resistor arrays 312, 322 and 332.

As described above, the first warming heat generating resistors and the second warming heat generating resistors are provided correspondingly to the first ejection heat generating resistor arrays and the second ejection heat generating resistor arrays, respectively.

In this embodiment, each of the warming heat generating resistors is formed in a layer of tantalum. The tantalum layer surface is oxidized into a layer of $Ta_2O_5$ when contacts the ink, thus exhibiting a resistance to corrosion by the ink. The tantalum layer is formed as a substrate upper layer of the ejection heat generating resistor and also functions as a cavitation-protecting film for protecting the ejection heat generating resistor from impact by bubble generation and collapse of the ink and so on.

In this embodiment, all the warming heat generating resistors are connected in parallel with each other by the wiring 101. The warming heat generating resistors are formed at a ratio of width (in a direction perpendicular to an ejection outlet array direction) of 2:3 (first warming heat generating resistor:second warming heat generating resistor) so that the first warming heat generating resistors and the second warming heat generating resistors have a resistance value ratio of 3:2. The first warming heat generating resistors and second warming heat generating resistors are connected in parallel with each other, so that these resistors have a heat generation amount ratio of 2:3. In this embodiment, the resistance value is changed by changing the width of the warming heat generating resistor. However, e.g., it is also possible to change the resistance value by changing a thickness or a material of the warming heat generating resistor.

Figure 10:
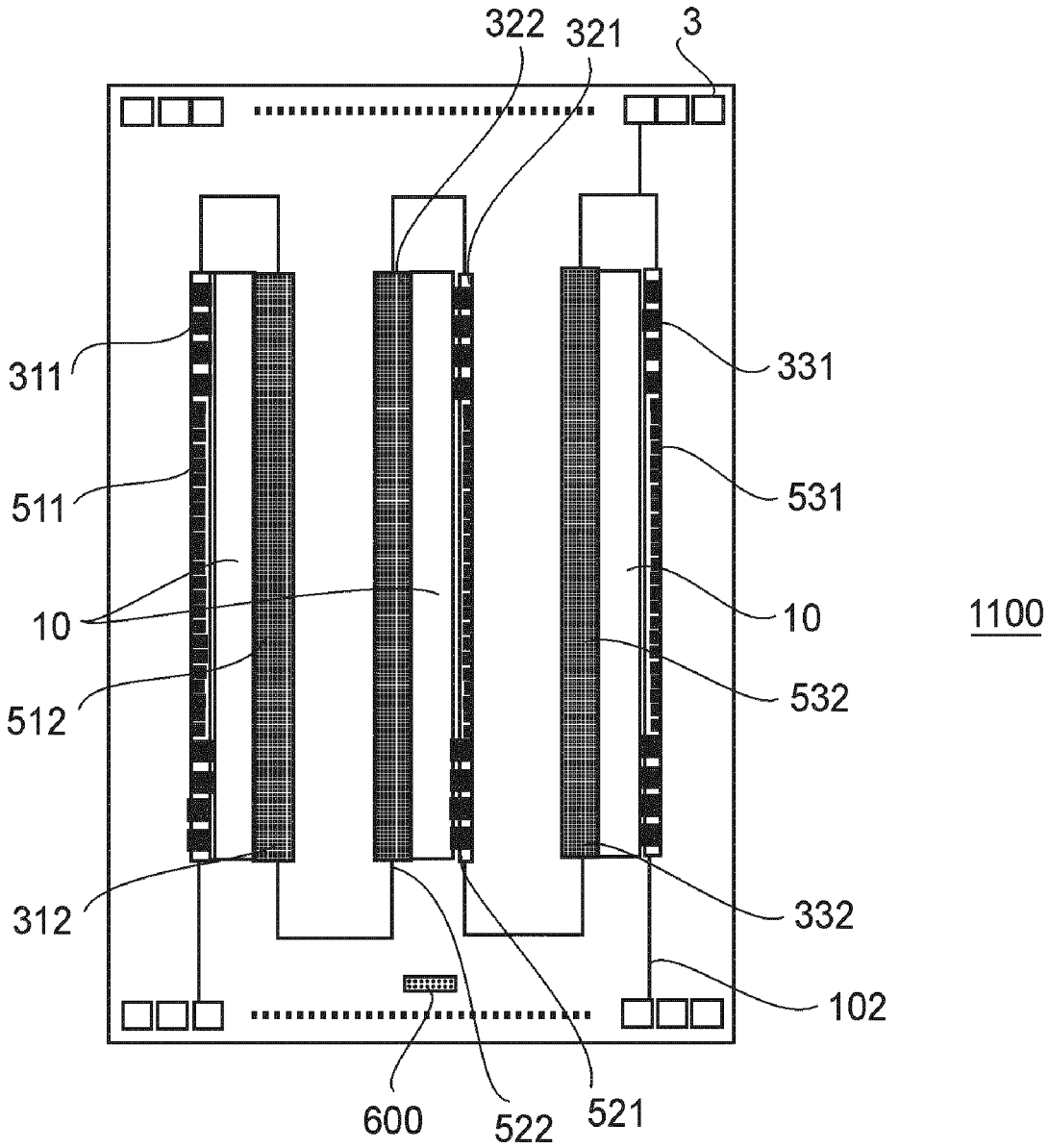
FIGS. 10 and 11 are plan views for schematically illustrating recording element substrates of the first embodiment and a second embodiment, respectively, according to the present invention.

As shown in FIG. 10, all the warming heat generating resistors may also be connected in series with each other by wiring 102. In this case, when the resistance value ratio between the first warming heat generating resistors and the second warming heat generating resistors is set to 2:3, the width ratio therebetween is 3:2.

Figure 17:
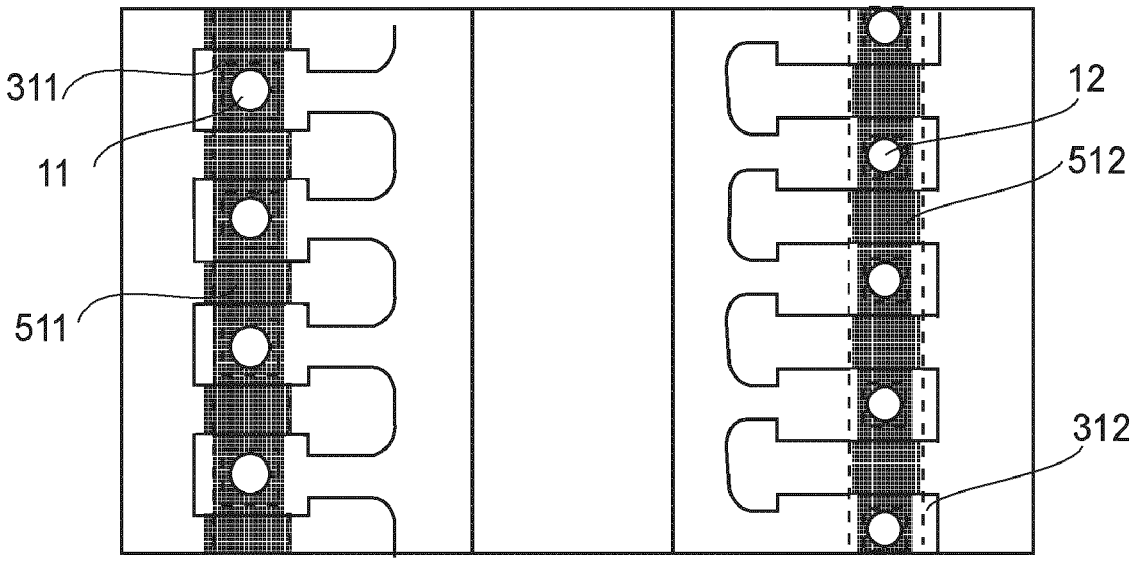
FIG. 17 is a partially plan view of the ink jet recording head according to the third embodiment of the present invention.

Further, the warming heat generating resistors may also be formed, as shown in FIG. 17, so that a resistance value of a portion thereof overlapping with an associated ejection heat generating resistor is higher than that of a portion thereof not overlapping with the ejection heat generating resistor when the warming heat generating resistor is projected onto the ejection heat generating resistor in a lamination direction of constituting layers of the recording element substrate. In the case where a current is caused to pass through the warming heat generating resistor, a width of the warming heat generating resistor in an ink flow path in the neighborhood of the ejection outlet (with respect to a direction perpendicular to the ejection outlet array direction) is relatively narrow, so that a heat generation amount at the portion is larger than those as other portions. For that reason, according to a constitution of this embodiment, compared with a portion not overlapping with the ink flow path, it is possible to efficiently heat the ink in the neighborhood of the ejection outlet.

The first and second warming heat generating resistors in this embodiment are formed so that the resistance of the portion thereof overlapping the ejection heat generating resistor is higher than that of the portion thereof not overlapping with the ejection heat generating resistor. However, in the present invention, only one (group) of the first and second warming heat generating resistors may also be formed in this manner.

The ink used in this embodiment has a property that a viscosity thereof is decreased with an increasing temperature thereof and is a liquid having such a property that a first ejection (shot) characteristic (an ejection characteristic of first ejection (shot) from a state in which ink is not ejected for some time) is good.

A relationship between an ink temperature and the first ejection characteristic in this embodiment is shown in Table 1.

TABLE 1

| IT*1 (° C.) | 15 | 25 | 30 | 40 | 50 | 60 |
|---|---|---|---|---|---|---|
| SN*2 (5 pl) | 0.5 | 1.5 | 2 | 6 | 7 | 7 |
| SN*2 (2 pl) | 0.5 | 1.0 | 1.5 | 4 | 6 | 7 |

*1ink temperature (° C.)
*2the number of scanning(s) (scan(s)) in an interrupted state As shown in Table 1, at the ink temperature of 25° C., when an interrupted state (in which the ejection is not effected) of not less than 1.5 scans for the ejection amount of 5 pl and of not less than 1.0 scan for the ejection amount of 2 pl is continued, the ink cannot be ejected stably. However, even in the ejection amount of 5 pl or in the ejection amount of 2 pl, when the ink temperature reaches 40° C. (for 5 pl) or 50° C. (for 2 pl), the ink ejection can be effected stably in the interrupted state of not more than about 5 scans.

In this embodiment, in order to heat the ink up to the above ink temperature, the resistance ratio between the first warming heat generating resistors and the second warming heat generating resistors is set to 3:2, but the present invention is not limited thereto.

As described above, the warming heat generating resistors are formed above the ejection heat generating resistors, so that the recording element substrate can be downsized to reduce a production cost. Further, the warming heat generating resistors are provided right above the ejection heat generating resistor, so that the ink immediately above the ejection heat generating resistor is selectively warmed to be lowered in viscosity. As a result, a resistance at a front portion of the ink flow path is smaller than that at a rear portion of the ink flow path, so that an ejection efficiency is increased. Therefore, it is possible to effectively eject the ink even at a low driving energy supplied to the ejection heat generating resistor.

Figure 5:
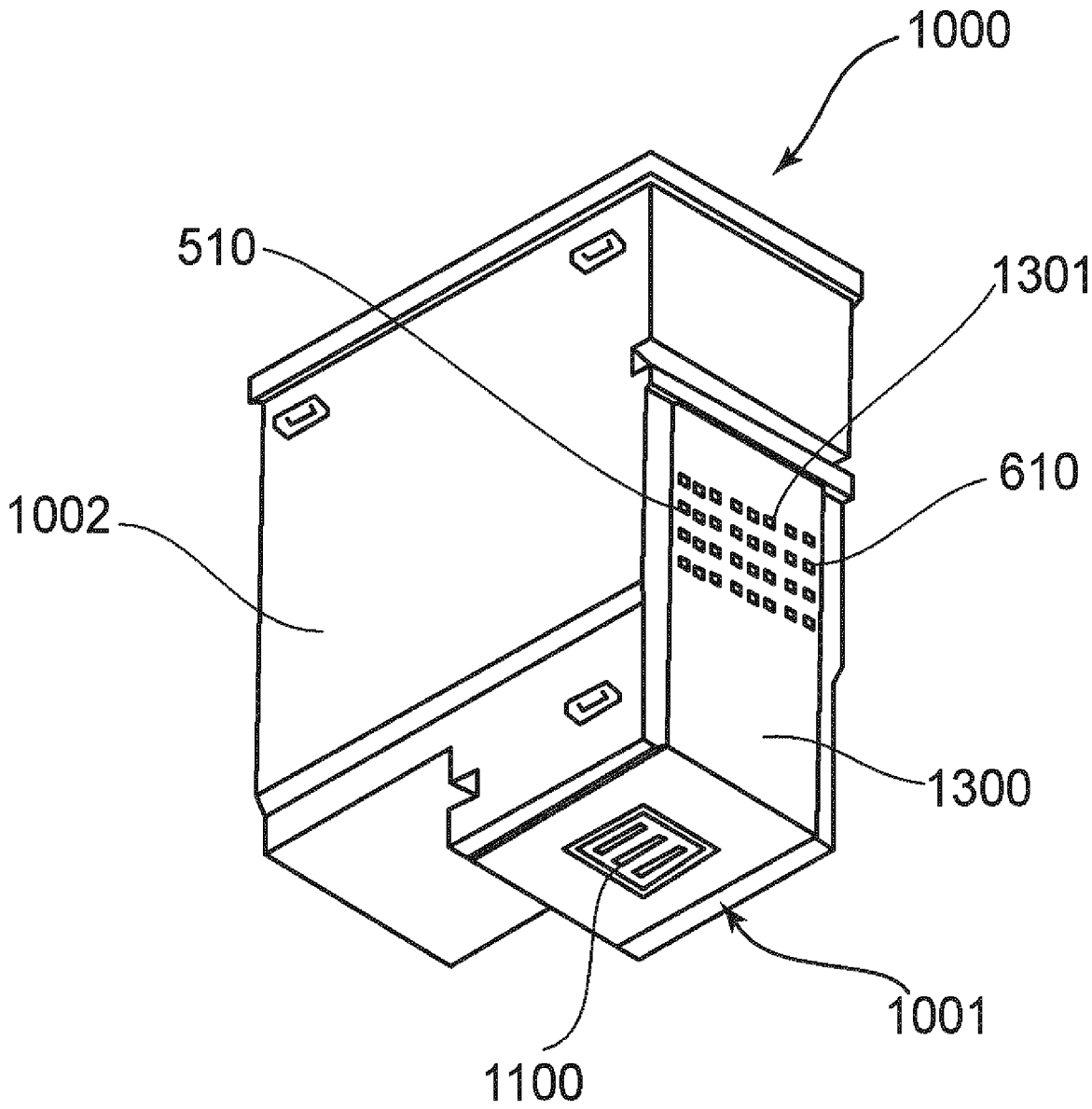
FIG. 5 is a perspective view of an ink jet cartridge according to the first embodiment of the present invention.

FIG. 5 is a perspective view of the recording head cartridge of this embodiment. As shown in FIG. 5, an a recording head cartridge 1000 is prepared by bonding a recording element substrate 1100 and an electric wiring substrate 1300, for applying a driving signal or the like from a recording apparatus main assembly (not shown) to the recording element substrate 1100, to an ink container portion.

When the recording head cartridge is driven, first, the warming heat generating resistors are supplied with the driving signal to generate heat. The warming heat generating resistors are connected in parallel with each other by the wiring 101, so that all the warming heat generating resistors start heat generation at the same time. By supplying the driving signal to the warming heat generating resistors for a certain time, the ink temperature reaches about 40° C. at an ejection outlet portion with the large ejection amount and reaches about 50° C. at an ejection outlet portion with the small ejection amount. Thereafter, a recording operation was performed. As a result, the recording operation was stably effected with no problem of a performance such as the first ejection characteristic.

A time for driving the warming heat generating resistors before start of the recording operation is automatically selected from a time table, between an ambient temperature and a warming heat generating resistor driving time, prepared in advance by measuring the ambient temperature with a head temperature sensor 600. Further, before the start of the recording operation, control is made so that an amount of heat generations is equal to or more than that of the first warming heat generating resistors when the head temperature is not more than a predetermined temperature.

Further, also during the recording operation, this control is similarly effected and in the case where the head temperature at the ejection outlet portion is detected by the head temperature sensor 600 during the recording operation and is likely to lower, the driving signal is supplied to the warming heat generating resistors. The ink used in this embodiment generates bubble unstably at the ink temperature of 80° C. or more, so that when the ink temperature detected by the head temperature sensor 600 is 75° C. or more, the warming heat generating resistors are not driven. Further, during the recording operation, the heat generation amounts of the first and second warming heat generating resistors are controlled, respectively, so that a minimum ink temperature at the first ejection outlet array portion is not more than that at the second ejection outlet array portion.

The head temperature sensor 600 for detecting the ink temperature may also be provided in the neighborhood of a central portion of each of the ink flow path arrays or in a plurality of points along the ink flow path array. An average of detected ink temperature values may be employed as the ink temperature. The head temperature sensor 600 may also be provided in a length substantially equal to the length of each ink flow path array along the ink flow path array.

The head temperature sensor 600 is, e.g., constituted by a diode or the like and detects the head temperature as described below. A forward voltage VF at the time when a certain current is caused to pass through a diode is detected and converted into a digital amount by inputting the detected value of the forward voltage VF into an A/D converter. On the basis of a correlation table between the forward voltage VF and the ink temperature prepared in advance by using the converted voltage values, the ink temperature is calculated.

By effecting drive control of the warming heat generating resistors as described above, drive of the warming heat generating resistors is eliminated and complicated pulse control is unnecessitated, so that it is possible to improve a recording speed. Further, it is possible to control the ink temperature so as to be an optimum temperature for providing each of the ejection amounts, so that recording can be effected in a state in which the head temperature of the ink jet recording head is always constant. As a result, it is possible to suppress the lowering in first ejection characteristic and the lowering in image quality such as streaks or non-uniformity due to the change in color density or color tone of an image to be recorded on the recording material.

According to the ink jet recording head of this embodiment, the warming heat generating resistors are formed between the ejection heat generating resistors and the ink flow paths by lamination, so that the ink can be temperature-retained at a portion close to the ink. Particularly, the warming heat generating resistors and the ink are disposed to directly contact each other, so that a heat transfer responsiveness from the warming heat generating resistor to the ink can be improved. For that reason, compared with such a constitution that the warming heat generating resistors are disposed in other positions, the ink can be temperature-retained with less driving energy.

Further, the warming heat generating resistors are not provided above the ejection heat generating resistors but are provided along a periphery of the ejection heat generating resistors, so that not only the ink at the ejection portion is temperature-retained by the warming heat generating resistors but also the driving energy of the ejection heat generating resistors is directly transmitted to the ink. For that reason, the warming heat generating resistors and the ejection heat generating resistors can be driven efficiently.

Further, by forming the warming heat generating resistors above the ejection heat generating resistors, the warming heat generating resistors can be used as an anti-cavitation layer.

Further, the warming heat generating resistors and the ejection heat generating resistors are not formed in the same layer, so that the recording element substrate can be downsized to suppress an increase in production cost.

Further, depending on a different ejection amount, the heat generation amount of the warming heat generating resistors is changed, so that the head temperature can be controlled at an optimum temperature for providing each of the ejection amounts. As a result, it is possible to eject the ink from all the ejection outlets in a stable ink amount with no increase in head temperature to a more-than-necessary temperature.

As described above, it is possible to provide an ink jet recording head which is reduced in driving energy consumption and is driven with high operation reliability.

Second Embodiment

Figure 11:
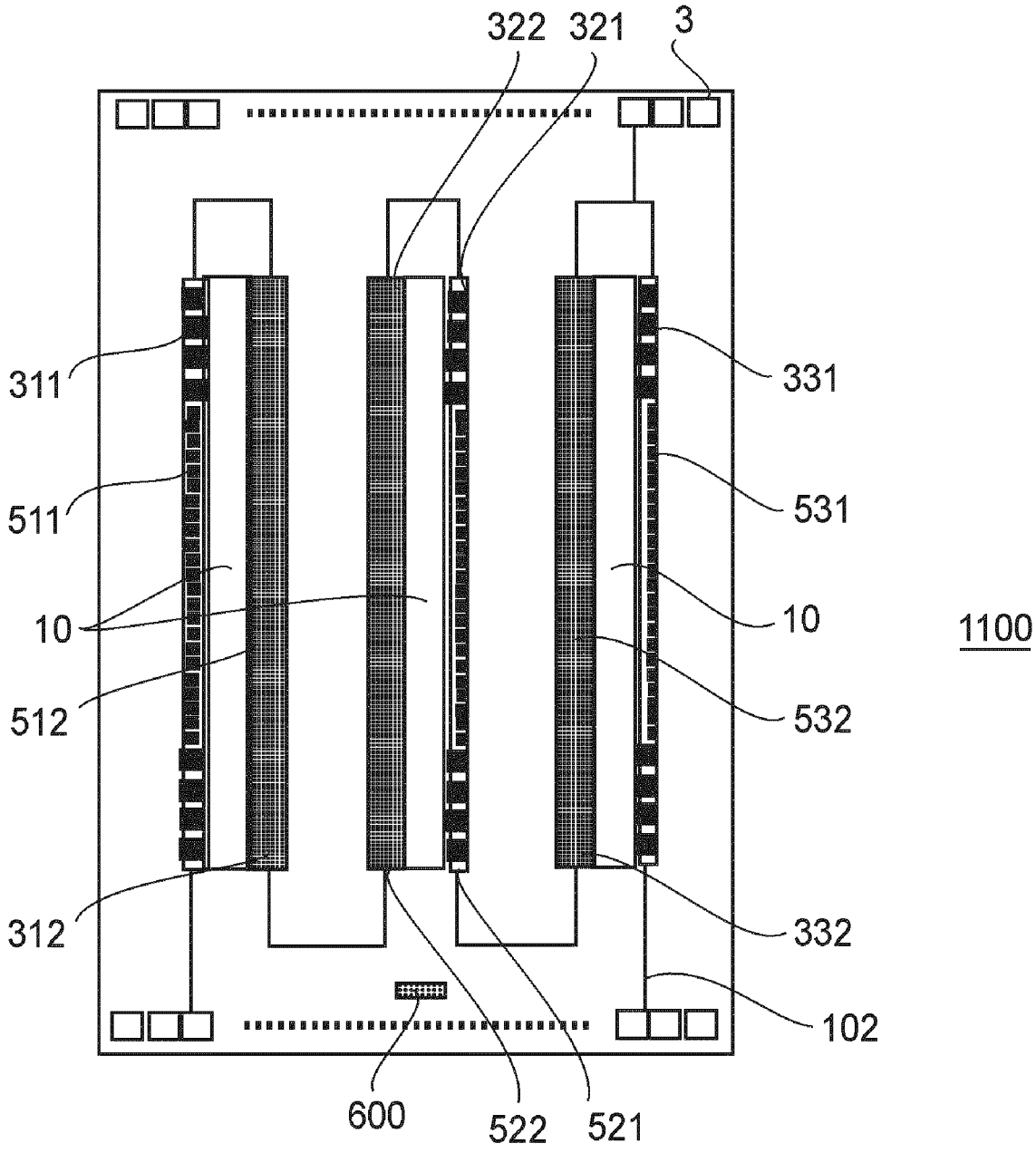

FIG. 11 is a schematic plan view showing a recording element substrate 1100 in this embodiment. In this embodiment, ejection outlet arrays 11, 12 and 13 are used for ejecting cyan ink, ejection outlet arrays 21, 22 and 23 are used for ejecting magenta ink, and ejection outlet arrays, 31, 32 and 33 are used for ejecting yellow ink. In the case of the same color ink, a common ink supply port 10 is used. In correspondence with each of the ejection outlet arrays, first ejection heat generating resistor arrays 311, 321 and 331, second ejection heat generating resistor arrays 312, 322 and 332, and third ejection heat generating resistor arrays 313, 323 and 333 are provided. Further, first warming heat generating resistors 511, 521 and 531 for ejection of ink in a large amount, second warming heat generating resistors 512, 522 and 532 for ejection of ink in a small amount, and third warming heat generating resistors 513, 523 and 533 for ejection of ink in a very small amount are formed. These warming heat generating resistors are independently electrically connected by wiring 111, 112 and 113, respectively.

In this embodiment, an ejection outlet diameter for the large amount ejection is about 17 μm and the large ejection amount is about 5 pl, an ejection outlet diameter for the small amount ejection is about 12 μm and the small ejection amount is about 2 pl, and an ejection outlet diameter for the very small amount ejection is about 10 μm and the very small ejection amount is about 1 pl.

Further, as shown in FIG. 9, a warming heat generating resistor 500 is laminated on a recording element substrate 1100 so that it is disposed above and over an ejection heat generating resistor array 219 and a part thereof is formed between an ink flow path 1104 and the ejection heat generating resistor array 219. All the first, second and third warming heat generating resistors 511, 521, 531, 512, 522, 532, 513, 523 and 533 are formed to have the same resistance value ratio.

In this embodiment, each of the warming heat generating resistors 500 formed in a layer of tantalum. The tantalum layer surface is oxidized into a layer of $Ta_2O_5$ when contacts the ink, thus exhibiting a resistance to corrosion by the ink. Generally, the tantalum layer is formed as a substrate upper layer of the ejection heat generating resistor 219 and also functions as an anti-cavitation film which is a cavitation-protecting film for protecting the ejection heat generating resistor from impact by bubble generation and collapse of the ink and so on.

As described above, the warming heat generating resistors 500 are formed above the ejection heat generating resistors 219, so that the recording element substrate 1100 can be downsized to reduce a production cost. Further, the warming heat generating resistors 500 are provided right above the ejection heat generating resistor 219, so that the ink immediately above the ejection heat generating resistor 219 is selectively warmed to be lowered in viscosity. As a result, a resistance at a front portion of the ink flow path is smaller than that at a rear portion of the ink flow path 219, so that an ejection efficiency is increased. Therefore, it is possible to eject the ink even at a low driving energy supplied to the ejection heat generating resistor 219.

Further, the first, second and third warming heat generating resistors are independently connected by wiring, so that the respective warming heat generating resistors are independently driven and controlled.

By using the recording element substrate in this embodiment, a recording head cartridge is prepared in the same manner as in First Embodiment.

The ink used in this embodiment can be stably ejected when the ink temperature reaches about 4° C. at the large ejection amount ejection outlet portion, about 50° C. at the small ejection amount ejection outlet portion, and about 55° C. at the very small ejection amount ejection outlet portion.

When the recording head cartridge is driven, first, the warming heat generating resistors are supplied with the driving signal to generate heat. The warming heat generating resistors are started to be driven to cause the ink temperature at the very small ejection amount ejection outlet portion to increase. Next, the second warming heat generating resistors 512, 522 and 532 are driven and finally, the first warming heat generating resistors 511, 521 and 531 are driven.

Thus, by deviating drive start times from each other, it is possible to control the ink temperature at a desired ink temperature.

By supplying the driving signal to each of the warming heat generating resistors for a corresponding time, the ink temperature reaches about 40° C. at the ejection outlet portion with the large ejection amount, about 50° C. at the ejection outlet portion with the small ejection amount and about 55° C. at the ejection outlet portion with the very small ejection amount. Thereafter, a recording operation was performed. As a result, the recording operation was stably effected with no problem of a performance such as the first ejection characteristic.

A time for driving the warming heat generating resistors before the recording operation is automatically selected from a time table, between an ink temperature and a warming heat generating resistor driving time, prepared in advance by measuring the ink temperature with a head temperature sensor 600. Incidentally, the head temperature sensor 600 is provided in a plurality of positions on the recording element substrate 1100 and by using an average of detected values by the sensors, it is possible to effect control with better accuracy.

Further, also during the recording operation, this control is similarly effected and a state in which the ink temperature at each ejection outlet portion likely to lower during the recording operation is detected by the head temperature sensor 600 and then the driving signal is supplied to the warming heat generating resistors. The ink generates bubble unstably when the ink temperature reaches 80° C. or more, so that when the ink temperature detected by the head temperature sensor 600 is 75° C. or more, the warming heat generating resistors are not driven.

By effecting drive control of the warming heat generating resistors as described above, drive of the warming heat generating resistors is eliminated and complicated pulse control is unnecessitated, so that it is possible to improve a recording speed. Further, it is possible to independently control the amount of heat generation of each of the warming heat generating resistors, so that the head temperature of the ink jet recording head can be kept at an optimum temperature for providing a desired ejection amount. As a result, it is possible to suppress the lowering in first ejection characteristic and the lowering in image quality such as streaks or non-uniformity due to the change in color density or color tone of an image to be recorded on the recording material.

Third Embodiment

Figure 12:
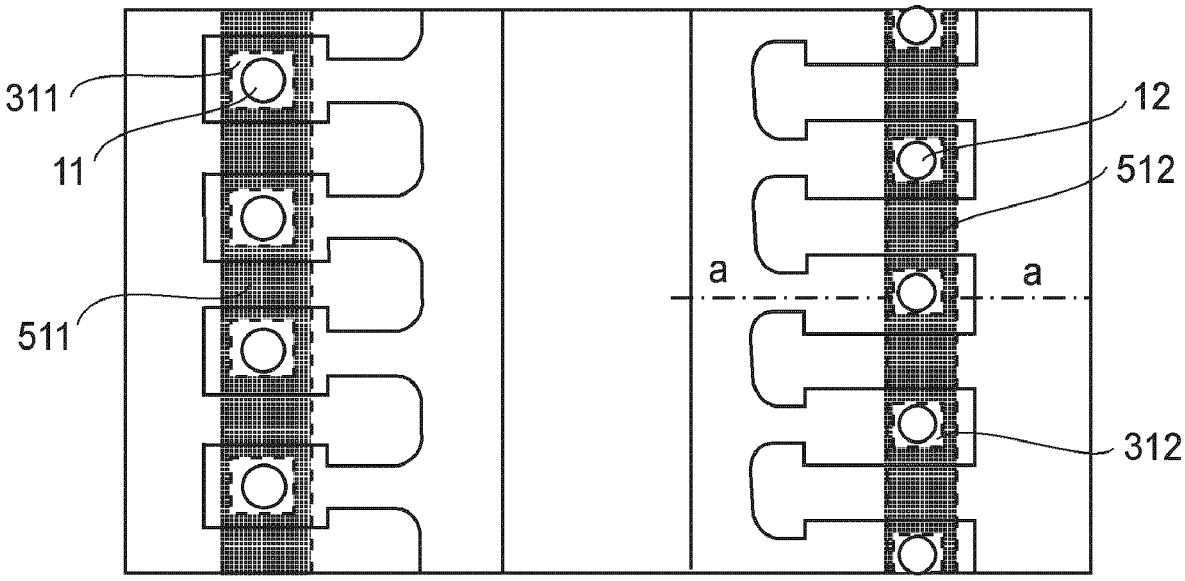
FIG. 12 is a partially plan view of an ink jet recording head of a third embodiment according to the present invention.
Figure 13:
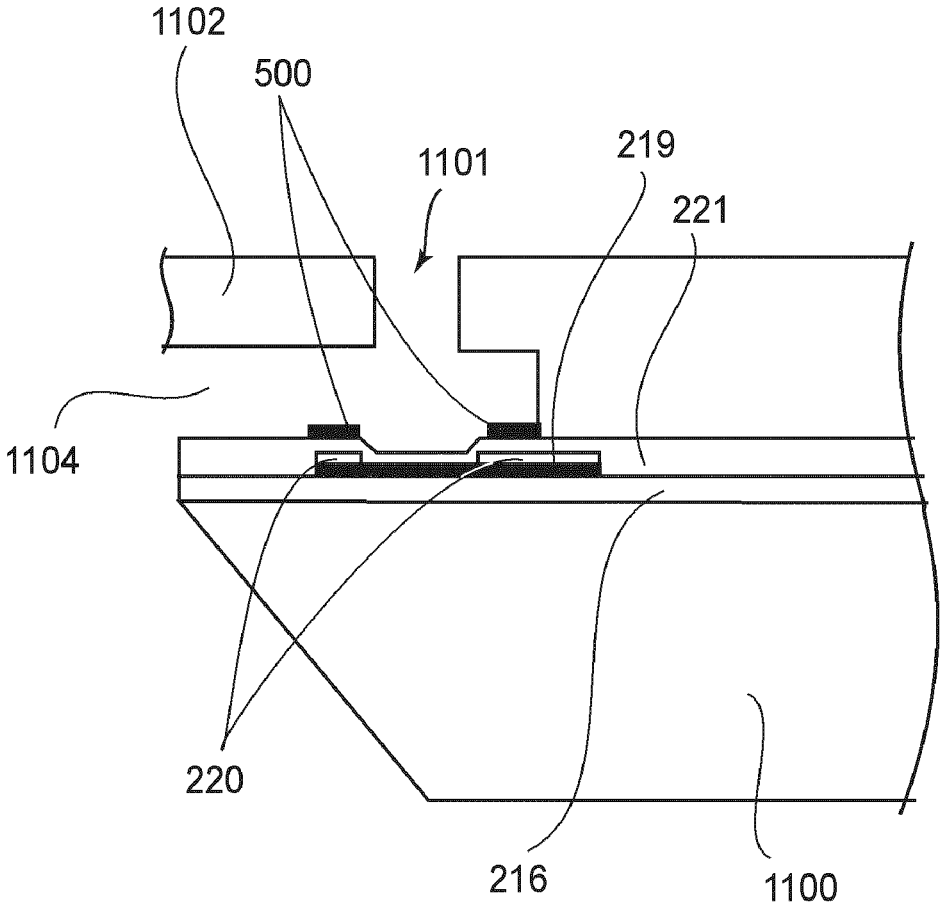
FIG. 13 is a partially sectional view of an ink jet recording head according to the third embodiment of the present invention.

FIGS. 12 and 13 are enlarged values of A portion shown in FIG. 7, for illustrating positions of the first warming heat generating resistors. FIG. 13 is taken along a-a line shown in FIG. 12. As shown in FIGS. 12 and 13, a part of a warming heat generating resistor 500 is disposed on a bottom surface of an ink flow path 1104 communicating with an ejection outlet 1101. Further, the warming heat generating resistor 500 is laminated above a recording element substrate 1100 via an ejection heat generating resistor 219 and an insulating layer 216 so that it extends above and over the ejection heat generating resistor 219 and surrounds an outer periphery of the ejection heat generating resistor 219 when it is projected onto the ejection heat generating resistor 219 in a lamination direction. In this manner, a first warming heat generating resistor 511 is provided correspondingly to a first ejection heat generating resistor array for ejection in a large ejection amount. The warming heat generating resistor 500 is formed in a layer of tantalum. The tantalum layer surface is oxidized into a layer of $Ta_2O_5$ when contacts the ink, thus exhibiting a resistance of corrosion by the ink. The tantalum layer is formed on a protecting film by patterning.

Further, as shown in FIG. 13, the warming heat generating resistor 500 is not formed above the ejection heat generating resistor 219 at an ejection portion, so that bubble generation energy by the ejection heat generating resistor 219 is directly transferred to the ink. Therefore, an ejection efficiency can be improved. Further, as shown in FIG. 12, the warming heat generating resistor 500 is formed so as to extend above and over the ejection heat generating resistor 219 and so as to surround the outer periphery of the ejection heat generating resistor 219, so that a resistance of the warming heat generating resistor is increased in the neighborhood of the ejection outlet to increase an amount of heat generation. That is, it is possible to efficiently heat the ink in the neighborhood of the ejection outlet.

Next, an operation in the case where recording operation instructions are provided will be described.

Figure 14:
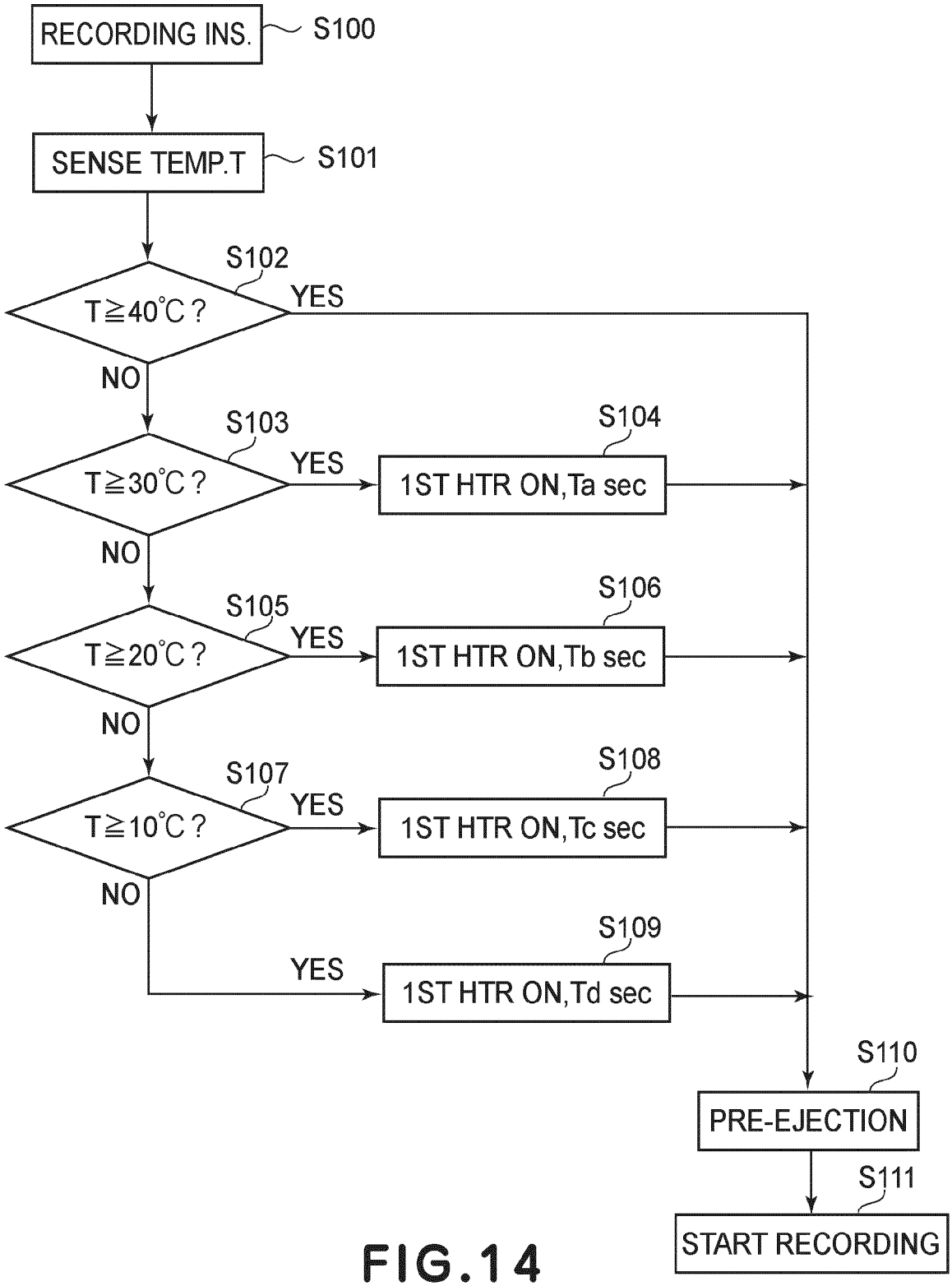
FIG. 14 is a flow-chart diagram illustrating a temperature control process during recording operation instructions according to the third embodiment of the present invention.

FIG. 14 is a flow-chart diagram of a temperature control process at the time of a recording operation instructions according to this embodiment. As described above, the viscosity of the ink used in the present invention is reduced with the rising of the temperature, and the first ejection (shot) property is improved. As described above, when the ink temperature is 40° C., after the preliminary ejection, the ink can be ejected stably in the interrupted state of about 6 or less scans. Referring to FIG. 14, a specific operation from the recording operation instructions to the recording operation start in this embodiment will be described while taking an operation for one ejection outlet array with the ejection amount of 5 pl as an example. When the recording operation instructions (step S100) is provided as shown in FIG. 14, the head temperature sensor 600 for a corresponding ejection outlet portion senses a current ink temperature (step S101). A refreshing operation, such as the suction, may be carried out after the step S100 (not shown). In the case of the ink temperature as a result of a temperature sensing being 40° C. or higher, a preliminary ejection is carried out as shown in the steps S102, S110, S111, and a recording operation is started. Since the head temperature is 40° C. or higher, the recording operation can be started in a state in which the stable ejection can be performed for a time corresponding to about 6 scans after the preliminary ejection.

When the ink temperature is not lower than 30° C. and lower than 40° C., the operation advances to the steps S103, S104, wherein the first warming heat generating resistor 501 carries out the heat generation for Ta second to raise the ink temperature by about 10° C. The Ta second is a heating time required to raise the ink temperature by about 10° C., and it is, e.g., about 0.5 second. As a result, the temperature of the ink in the ejection outlet array 11 reaches about 40° C. Thereafter, the preliminary ejection (step S110) is carried out and a recording operation (step S111) is started.

When the temperature of the ink is not lower than 20° C. and lower than 30° C., the operation advances to the steps S105, S106, wherein the first warming heat generating resistor 511 is energized for Tb (>Ta) second. Thereafter, the preliminary ejection (step S110) is carried out and the recording operation (step S111) is started. At this time, the temperature of the ink in the ejection outlet array 11 is about 40° C.

Similarly, as to the case where the head temperature is not lower than 10° C. and lower than 20° C., in order that the first warming heat generating resistor 511 raises the ink temperature by about 30° C., it is energize for the Tc (>Tb) second, and the recording operation is carried out after the preliminary ejection (steps S107, S108, S110, S111).

When the head temperature is 10° C. or lower, the first warming resistor 501 is energized for Td (>Tc) second for raising the ink temperature up to about 40° C. Thereafter, the preliminary ejection is carried out and then the recording operation is started (steps S107, S109, S110, and S111).

Further, in the case where the control as described above is carried out with respect to a plurality of ejection outlet arrays, the above-described operations are performed with respect to all the ejection outlet arrays and after ink temperatures in all the ejection outlet array are not less than set values, the preliminary ejection is performed and the recording operation is started (steps S110 and S111).

By carrying out the control as described above, the recording can be started in a state in which the ink temperature reaches about 40° C. at which an image can be formed stably with no preliminary ejection for a time corresponding to about 6 scans.

Figure 15:
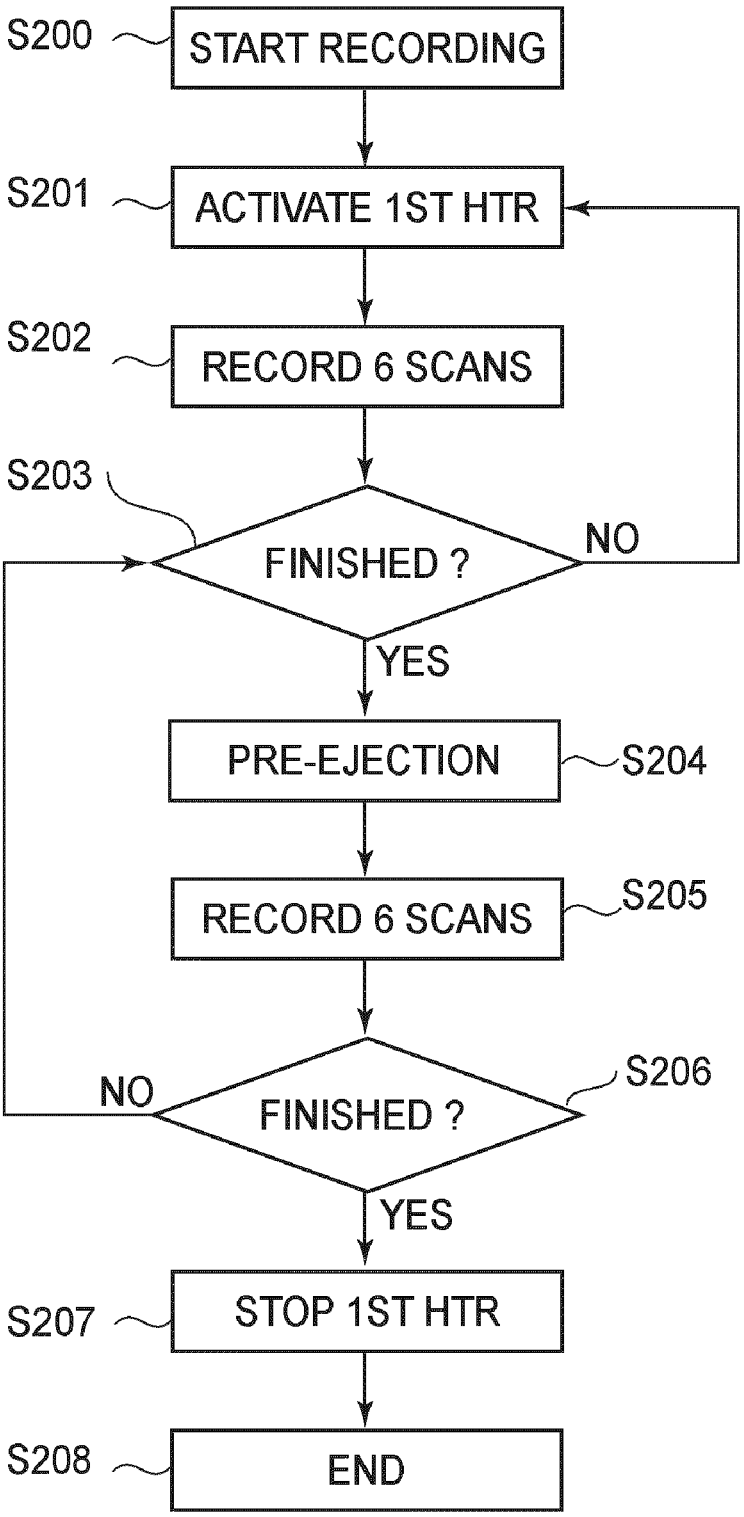
FIG. 15 is a flow-chart diagram illustrating a temperature control process after starting the recording operation according to the present invention.
Figure 16:
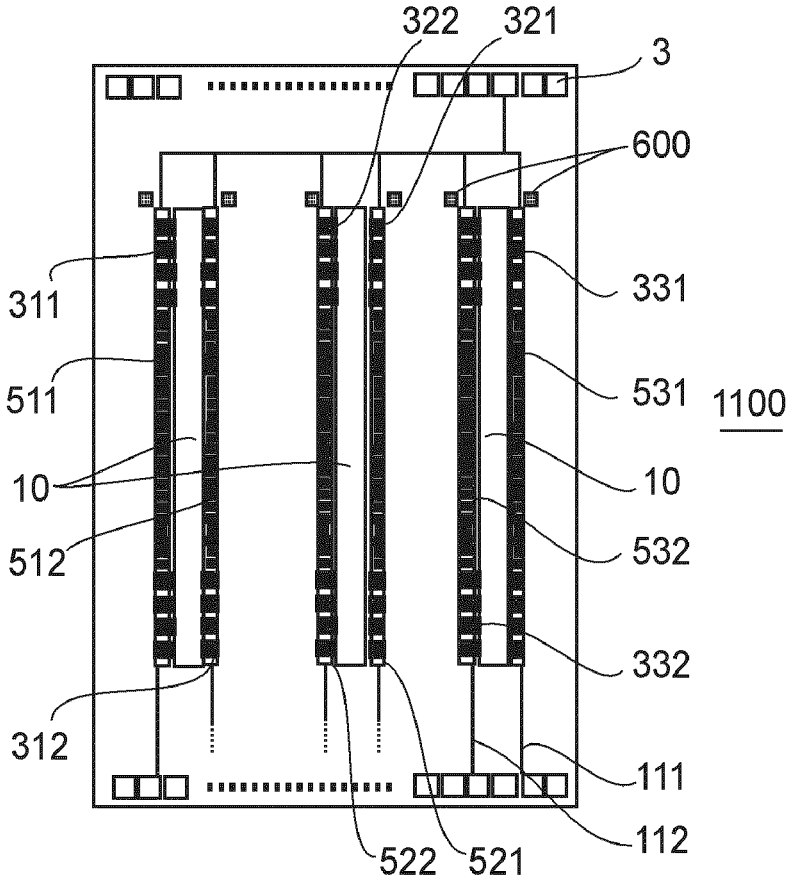
FIG. 16 is a plan view for schematically illustrating a recording element substrate according to the third embodiment of the present invention.

The description will be made about the operation after the recording start referring to FIGS. 16 and 15 while taking an operation for one first ejection outlet array (with an ejection amount of 5 pl in this embodiment) as an example. When the recording operation is started (step S200), the operation advances to a step S201, in which the first warming heat generating resistor 511 starts the heat generating operation so that the ink temperature at the first ejection outlet array 11 portion detected by the head temperature sensor 600 is about 40° C. At this time, as described above, since the head temperature is about 40° C., the stable ejection can be carried out. When the recording for the 6 scans (step S202) is finished, the ink temperature at the first ejection outlet array 11 portion is detected by the head temperature sensor 600 (step S203). When the ink temperature is 40° C. or more, the operation advances to a step S204. When the ink temperature is less than 40° C., the operation is returned to the step S201, in which the heat generation of the first warming heat generating resistor 511 is carried out, so that the ink temperature at the first ejection outlet array 11 portion is 40° C. or more. In the step S204, the preliminary ejection is carried out and the recording operation of 6 scans is carried out again (step S205). When the recording operation of the step S205 finishes, the operation advances to a step S206, in which the discrimination is made about whether all the recording operations have finished, and, if not, the operation returns to the step S203 and the ink temperature detection is carried out again, if so, energization of the first warming heat generating resistor 511 is stopped (step S207), and the operation is finished (step S208).

In the case of effecting the control with respect to all the ejection outlet arrays, the above-described operations are carried out with respect to all the ejection outlet arrays. After the recording operation for 6 scans is performed with respect to all the ejection outlet arrays (step S202), in the step S203, ink temperatures with respect to all the ejection outlet arrays are detected by head temperature sensors 600 each provided to each of the ejection outlet arrays. Of the detected ink temperatures, in the case where there is an ink temperature less than a set temperature with respect to an ejection outlet array, the ink jet recording head is not driven and placed in a standby state until the ink temperatures for all the ejection outlet arrays are not less than the set temperature. After the ink temperatures for all the ejection outlet arrays reach the set temperature or more, the preliminary ejection is performed (step S204) and then the recording operation is started (step S205). Thereafter, the above-described operations are repeated until the recording operation is completed.

As described above, by effecting drive control of the warming heat generating resistor, it is possible control the ink temperature so as to be an optimum ink temperature for realizing a stable ejection amount with respect to all the ejection outlet arrays. By this, it is possible to suppress a lowering in first ejection characteristic and a lowering in image quality such as streaks, non-uniformity or the like due to a change in color density or color tone of an image to be recorded on the recording material.

Fourth Embodiment

Figure 20:
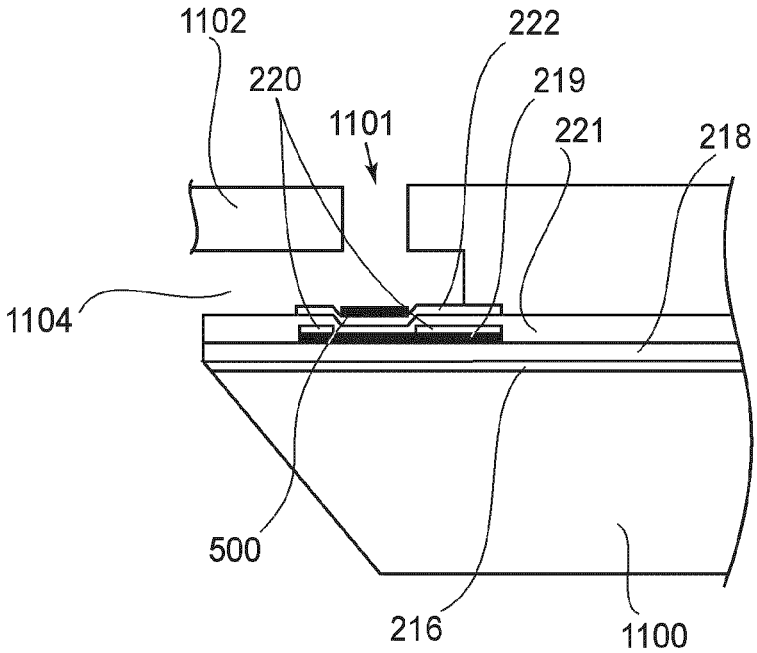
FIG. 20 is a sectional view taken along a-a line shown in FIG. 19.

As shown in FIG. 20, the warming heat generating resistor extends over and above the ejection heat generating resistor and is laminated above the recording element substrate via the ejection heat generating resistor and the insulating layer so that a part of the warming heat generating resistor is formed between the ink flow path and the ejection heat generating resistor. Thus, each of the first warming heat generating resistors is provided correspondingly to each of the election outlet arrays.

The warming heat generating resistor 500 is formed in a layer of tantalum simultaneously with formation of a logic circuit (not shown) of the recording element substrate. The tantalum layer surface is oxidized into a layer of $Ta_2O_5$ when it contacts the ink, thus exhibiting a resistance to corrosion by the ink. The tantalum layer is formed as a substrate upper layer of the ejection heat generating resistor and also functions as an anti-cavitation film which is a cavitation-protecting film for protecting the ejection heat generating resistor from impact by bubble generation and collapse of the ink and so on.

As shown in FIG. 20, the warming heat generating resistors are formed above the ejection heat generating resistors, so that the recording element substrate can be downsized to reduce a production cost. Further, the warming heat generating resistors are provided right above the ejection heat generating resistor, so that the ink immediately above the ejection heat generating resistor is selectively warmed to be lowered in viscosity. As a result, a resistance at a front portion of the ink flow path is smaller than that at a rear portion of the ink flow path, so that an ejection efficiency is increased. Therefore, it is possible to eject the ink even at a low driving energy supplied to the ejection heat generating resistor.

Figure 18:
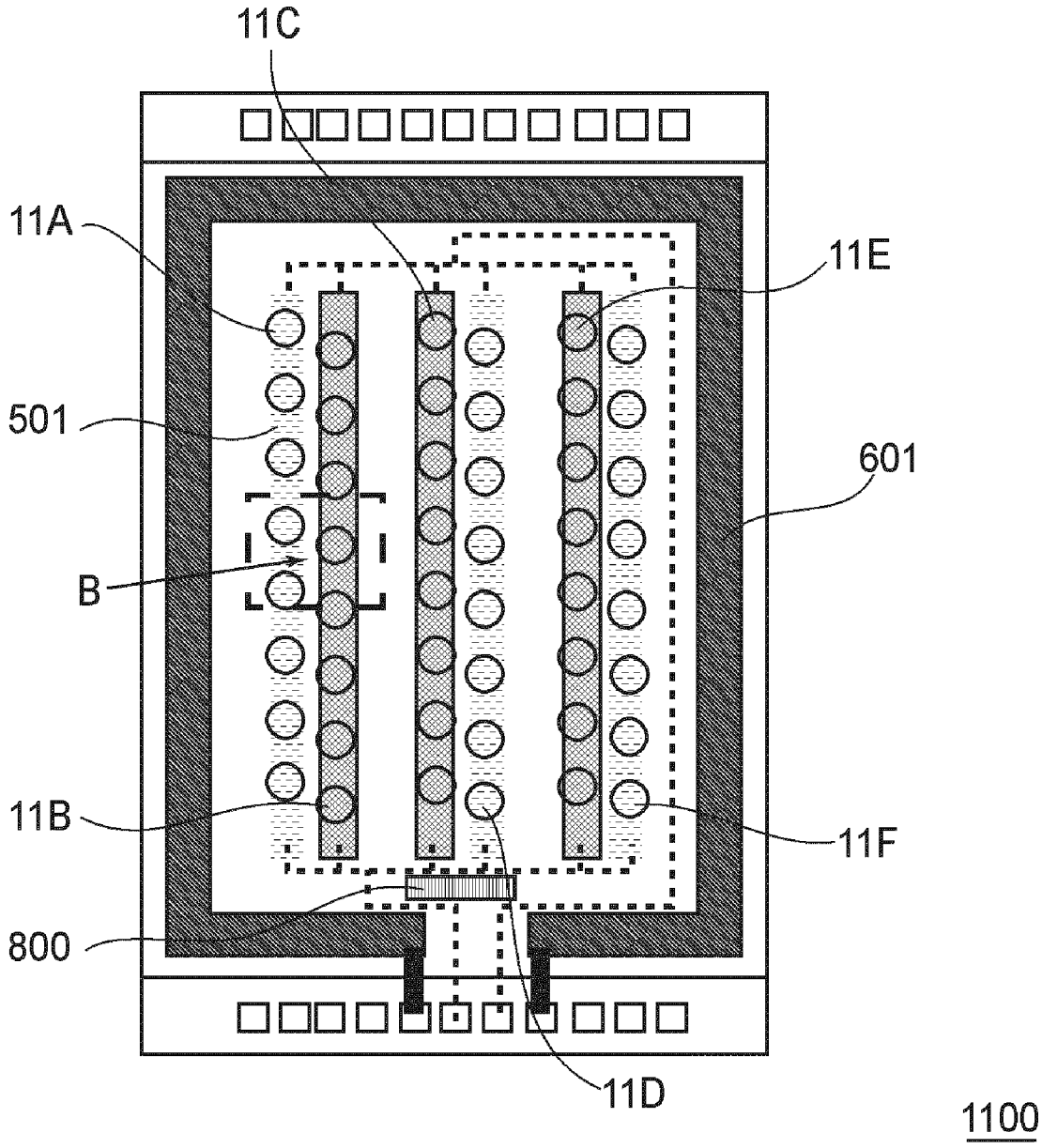
FIG. 18 is a plan view of a recording element substrate according to a fourth embodiment of the present invention.

FIG. 18 is a top plan view of the recording element substrate 1100 in this embodiment.

The recording element substrate 1100 has a head temperature sensor 800 for sensing (detecting) a temperature of the recording element substrate 1100. Although a head temperature sensor is, for example a thermistor, it may be a device of another type if it can sense the head temperature.

In this embodiment, the cyan ink, the magenta ink, and the yellow ink (three color inks) are used. The ejection outlet 1101 has a round form and an ejection outlet diameter thereof is 11.6 μm, wherein the one drop (ejection amount of the ink) ejected is about 2.5 ng. Ejection outlet arrays 11A and 11B eject the cyan ink, ejection outlet arrays 11C and 11D eject the magenta ink, and ejection outlet arrays 11E and 11F eject the yellow ink. The first warming heat generating resistors 501A to 501F are provided correspondingly to the ejection outlet arrays 11A to 11F, respectively. The first warming heat generating resistor 501 is connected by the wiring (connecting line) 101 in the same layer. The width (with respect to a direction perpendicular to an ejection outlet array direction) of this first warming heat generating resistor is, e.g., about 3 μm, and a resistance value thereof is 192 ohms, wherein when a voltage of 24V is applied thereto, an amount of heat generation is approx. 3W. As shown in FIG. 18, the second warming heat generating resistor 601 is provided along a full circumference of the recording element substrate 1100. The width of this second warming resistor is, for example, 4 μm. This first warming heat generating resistor 501 and second warming heat generating resistor 601 are electrically connected with the first heating contact pad 510 and the second heating contact pad 610 shown in FIG. 5 as described above, respectively. The first warming heat generating resistor 501 generates heat by energizing the first heating contact pad 510. The second warming heat generating resistor 601 generates heat by energizing the second heating contact pad 610. With the structure as described above, in this embodiment, the first warming heat generating resistor 501 and the second warming heat generating resistor 601 can be controlled independently from each other.

Figure 19:
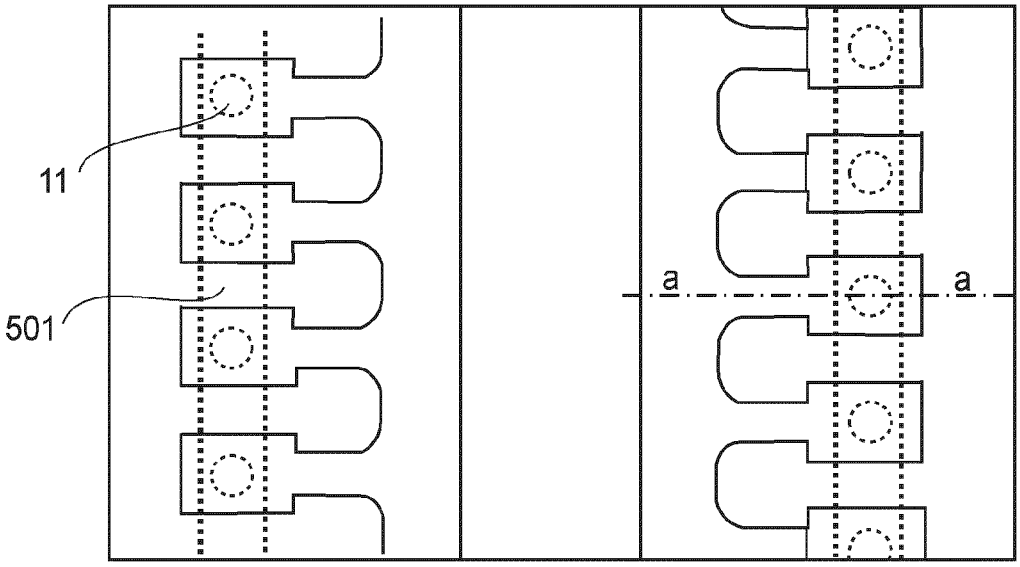
FIG. 19 is an enlarged view of B portion shown in FIG. 18.

FIG. 20 illustrates the position of the first warming heat generating resistor and is the a-a sectional view of FIG. 19. As shown in FIG. 20, a part of first warming resistor 500 is provided at a lower portion the ink flow path which communicates with the ejection outlet 1101, in order to supply the ink to the ejection outlet 1101. Since a viscosity of the ink used in this embodiment is reduced with the increasing ink temperature, the first ejection (shot) characteristic is improved.

As shown in Table 1, when the head temperature detected by the head temperature sensor 800 is 15° C., the continuation of the interrupted state (non-ejection) for the time duration of 0.5 or more scanning operations disturbs the stable ink ejection. However, when the head temperature reaches 40° C., the stable ink ejection is maintained also after the interrupted state for the time duration of about 6 scans. When the head temperature is 50° C., the stable ejection is maintained also after the interrupted state for the time duration of about 7 scans.

Also in this embodiment, similarly as in the recording operation in First Embodiment described with reference to FIG. 14, the recording operation is started after the first and second warming heat generating resistors are controlled respectively in the case where the recording operation instructions are provided.

Also in this embodiment, by effecting the control in the same manner as in First Embodiment, the recording operation can be started in such a state that the ink temperature reaches about 40° C. at which stable image formation can be carried out for the time duration of the 6 scans with no preliminary ejection.

Figure 21:
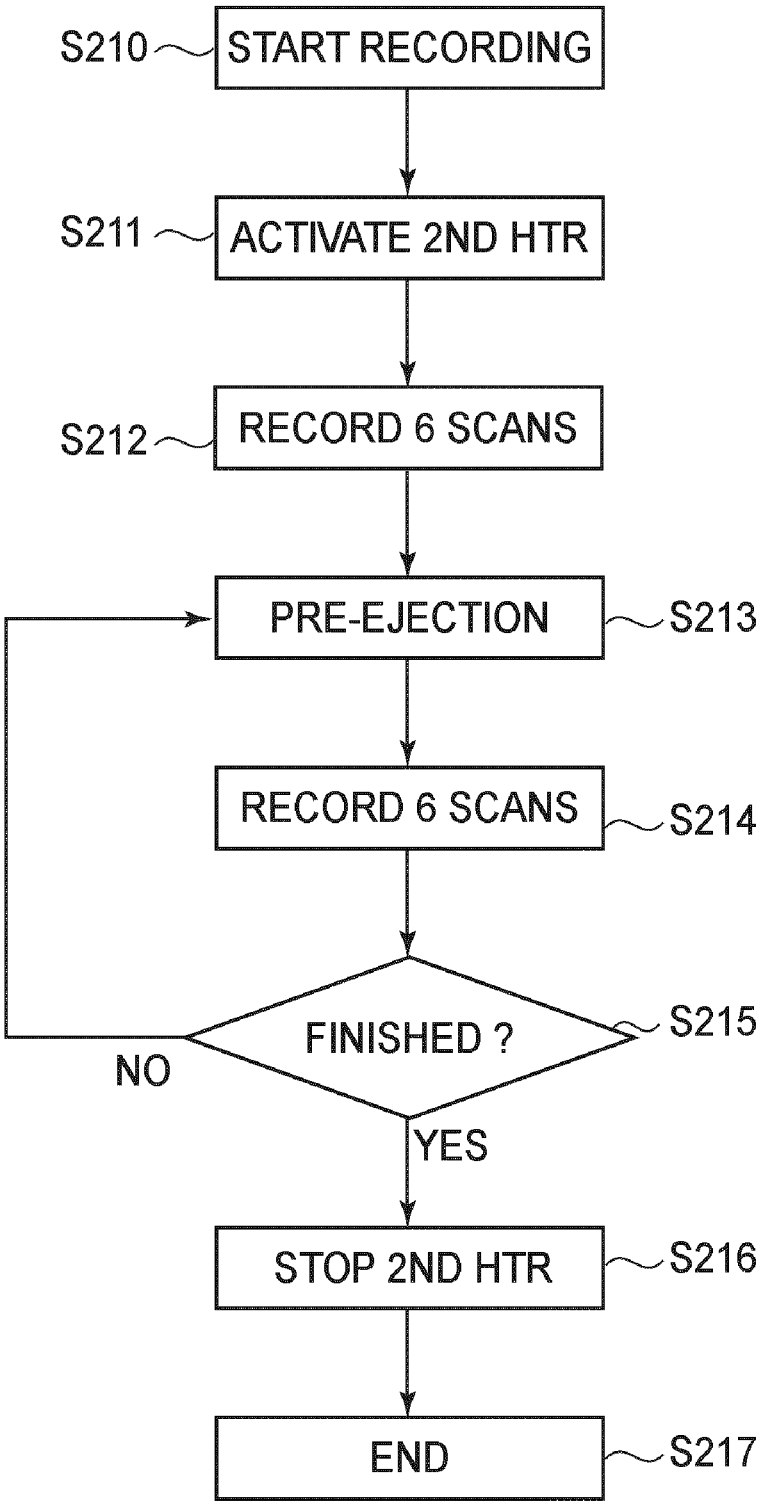
FIG. 21 is a flow-chart diagram illustrating a process for controlling an ink temperature after starting a recording operation in the fourth embodiment of the present invention.

Next, an operation after the start of the recording operation in this embodiment will be described with reference to FIG. 18 and FIG. 21. As shown in FIG. 21, when the recording operation is started (step S210), the energization of the second warming heat generating resistor 601 is started as shown in a step S211. The second warming heat generating resistor 601 is provided so that it surrounds the circumference of the recording element substrate 1100 as shown in FIG. 18, and therefore, the end of the recording element substrate 1100 which exhibits the relatively large heat dissipation can be warmed effectively. By this, the ink in the end of the recording element substrate 1100 can also be warmed and the recording operation for the six scans (step S212) is carried out in this state. At this time, as described above, since the head temperature reaches about 40° C., the stable ejection can be performed. After the recording operation for the six scans (step S212) is finished, the preliminary ejection (step S213) is carried out and the recording operation for the additional 6 scans carried out (step S214). When the recording operation in the step S204 finishes, the discrimination is made about whether all the recording operations are finished in a step S215. If not, the operation returns to the step S213, wherein a preliminary ejection is carried out again. If so, the energization of the second warming heat generating resistor 601 is stopped (step S216), and the operation finishes (step S217).

Figure 22:
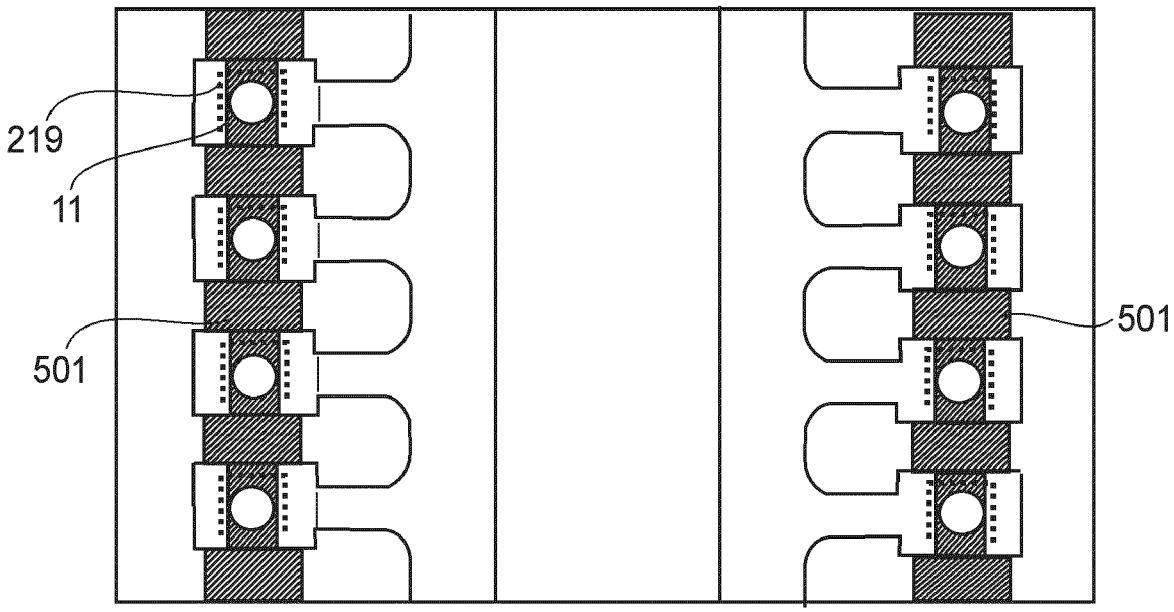
FIG. 22 is an enlarged view of the B portion shown in FIG. 18.

Further, the first warming heat generating resistor 501 may also be formed, as shown in FIG. 22, so that a resistance value of a portion thereof overlapping with an associated ejection heat generating resistor is higher than that of a portion thereof not overlapping with the ejection heat generating resistor when the first warming heat generating resistor 501 is projected onto the ejection heat generating resistor. The first warming heat generating resistor 501 is formed above the ejection heat generating resistor 219 by the same wiring so that it extends over an associated ejection outlet array, for one of the colors, of the ejection outlet arrays. According to this constitution, compared with a portion not overlapping with the ejection heat generating resistor, it is possible to efficiently heat the ink in the neighborhood of the ejection outlet.

As described above, the ink is heated by causing the first warming heat generating resistor 501 to generate heat during the start of the recording operation, so that the first ejection characteristic is improved. Further, in this embodiment, the recording operation is performed while heating the second warming heat generating resistor 601, so that it is possible to suppress an occurrence of a temperature distribution, between an end portion and a central portion of the recording element substrate 1100, due to heat dissipation from the end portion of the recording element substrate 1100, due to heat dissipation from the end portion of the recording element substrate 1100. For this reason, according to this embodiment, the ink ejection characteristic in the recording element substrate 1100 can be kept at a constant level. Therefore, it is possible to suppress the lowering in image quality such as streaks, non-uniformity or the like due to a change in color density or color tone of an image to be recorded on the recording material.

Fifth Embodiment

In this embodiment, an ink jet recording head and an ink jet recording apparatus are the same as those in Fourth Embodiment.

Figure 23:
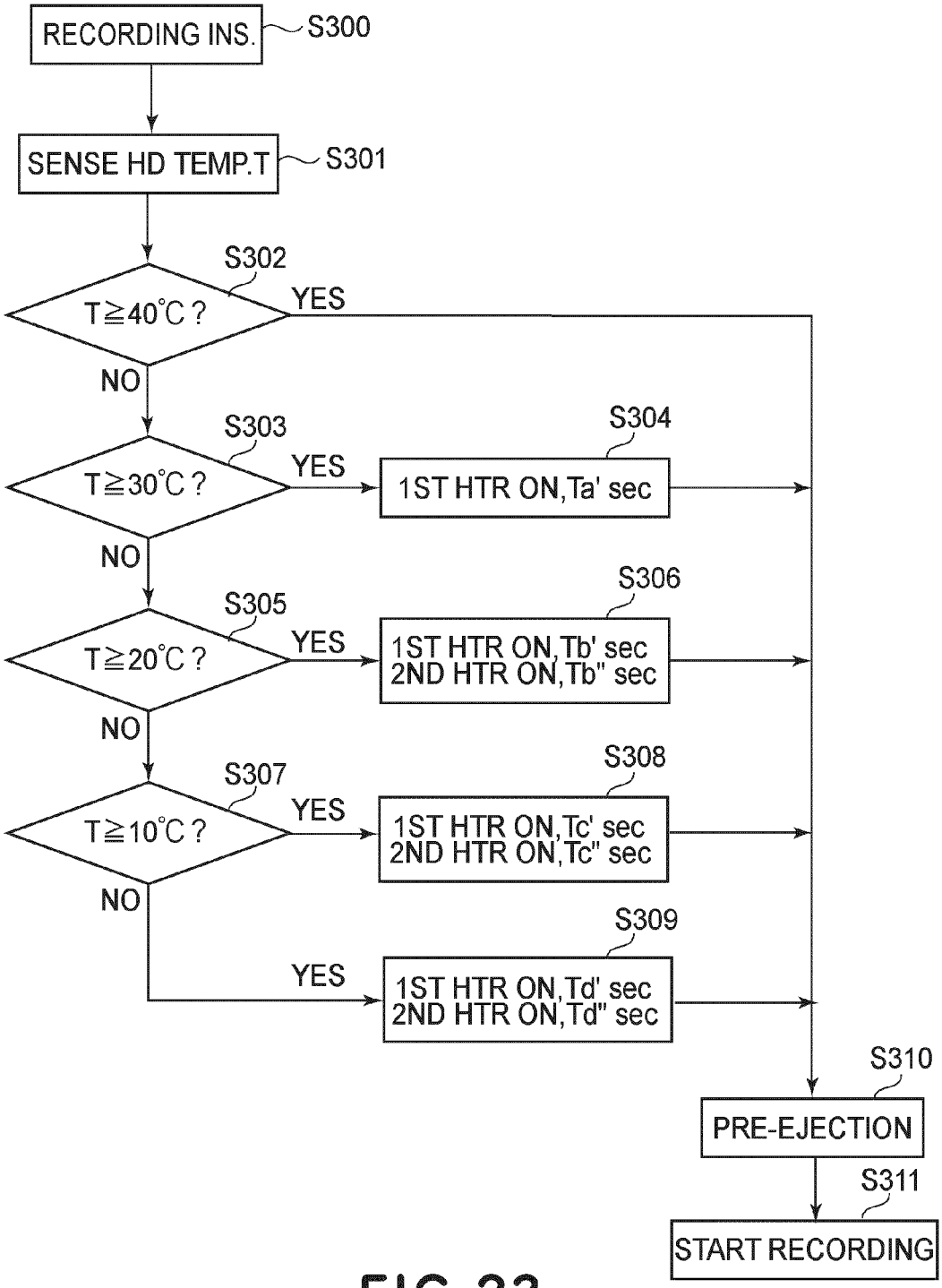
FIG. 23 is a flow-chart diagram illustrating a process for controlling an ink temperature during recording operation instructions in a fifth embodiment of the present invention.

FIG. 23 is a flow-chart diagram of a temperature control process at the time of recording operation instructions according to this embodiment of the present invention. Referring to FIG. 23, a specific operation from the recording operation instructions to the recording start in this embodiment will be described. When the recording operation instructions (step S300) is produced, the head temperature sensor 800 (FIG. 18) senses a current head temperature (step S301). A refreshing operation, such as the ink suction, may be carried out after the step S300. In the case of the head temperature as a result of a temperature sensing being 40° C. or high, a preliminary ejection is carried out and a recording operation is started as shown in the steps S302, S310, and S311. Since the head temperature is 40° C. or higher, the recording operation can be started in a state in which the stable ejection can be performed for the time duration for about 6 scans after the preliminary ejection.

When the head temperature is not lower than 30° C. and lower than 40° C., the operation advances to the steps S303, S304, wherein the first warming heat generating resistor 501 carries out the heat generation for Ta' second to raise the ink temperature by about 10° C. The Ta' second is a heating time required to raise the ink temperature by about 10° C., and it is about 0.5 second.

Thereafter, the preliminary ejection (step S310) is carried out and the record starting operation (step S311) is carried out.

When the head temperatures is not lower than 20° C. and lower than 30° C., the operation advances to the steps S305, 306, in which the first warming heat generating resistor is energized for Tb' (<Tb) second, and the second warming heat generating resistor is energized for the Tb" (>Tb) second. By also energizing the second warming heat generating resistor in addition to the first warming heat generating resistor, the about 20° C. temperature rise can be accomplished by the time shorter than the time Tb which the energization of only the first warming heat generating resistor in the First Embodiment takes.

As described above, the resistance value of the first warming heat generating resistor is larger than the resistance value of the second warming heat generating resistor. Furthermore, the first warming heat generating resistor is provided in the position nearer to ejection outlet than the second warming heat generating resistor. Therefore, the heat generating time Tb' of the first warming heat generating resistor is preferably longer than or the same as the heat generating time Tb" of the second warming heat generating resistor, in order to raise the ink temperature. Thus, the amount of heat generation of the first warming heat generating resistor is larger than the amount of heat generation of the second warming heat generating resistor. Thereafter, the operation advances to the step S310 and the step S311, in which the preliminary ejection and the record starting operation is carried out, respectively.

Similarly, in the case of the head temperature being not lower than 10° C. or lower than 20° C., the operation advances to the steps S307, S308, wherein the first warming heat generating resistor 501 is energized for Tc' second, and the second warming heat generating resistor is energized for the Tc" second. By doing so, the ink temperature is raised by about 30° C. Similarly to the case where the head temperature is not lower than 20° C. and lower than 30° C., it is preferable that $Tc'' \leqq Tc' < Tc$ is satisfied, and it is preferable that the amount of heat generation of the first warming heat generating resistor is larger than the amount of heat generation of the second warming heat generating resistor. Thereafter, the operation advances to the step S310 and the step S311, in which the preliminary ejection and the record starting operation are carried out, respectively.

Similarly, when the head temperature is 10° C. or lower, the first warming heat generating resistor 501 is energized for Td' second, and the second warming heat generating resistor is energized for the Td" second to raise the ink temperature to about 40° C. It is preferable to satisfy $Td'' \leqq Td' < Td$, and it is preferable that the amount of heat generation of the first warming heat generating resistor is larger than the amount of heat generation of the second warming heat generating resistor. Thereafter, the preliminary ejection and the record starting operation are carried out in the step S310 and the step S311, respectively.

By the control as described above, the recording operation can be started without the preliminary ejection for the duration of about 6 scans with about 40° C. which is the ink temperature with which the stable image forming operation is possible. Furthermore, the ink temperature can be raised in the shorter time, than in the case of the usage of only the first warming heat generating resistor, by energizing the second warming heat generating resistor in addition to the first warming heat generating resistor.

Figure 24:
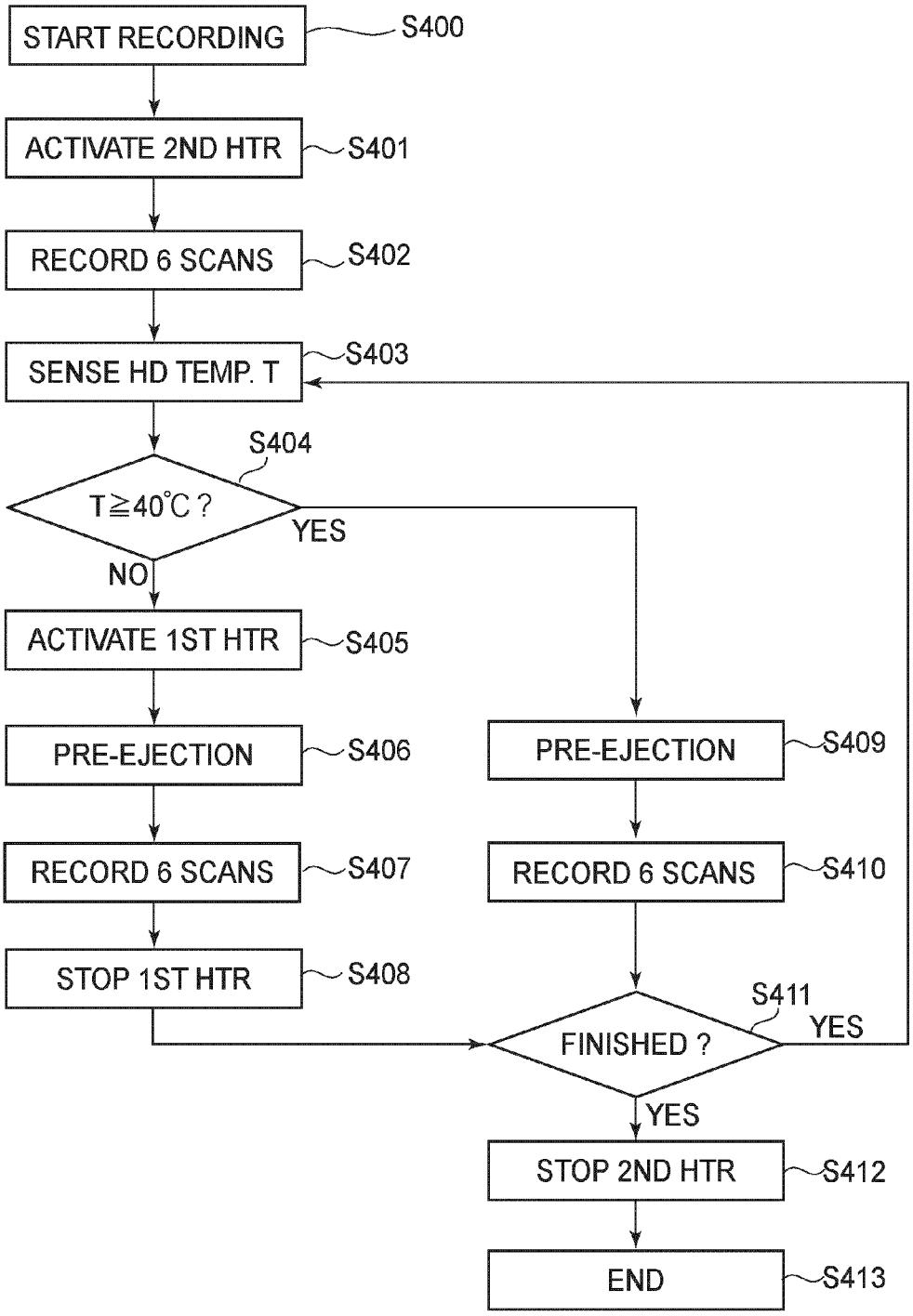
FIG. 24 is a flow-chart diagram illustrating the process for controlling the ink temperature after starting the recording operation in the fifth embodiment of the present invention.

The description will be made about the operation after the recording operation start referring to FIG. 24. When the recording operation is started (step S400), the energization of the second warming heat generating resistor 601 is started as shown in a step S401. The second warming heat generating resistor 601 is provided so that it surrounds the outer circumference of the recording element substrate 1100 as shown in FIG. 18, and therefore, the end of the recording element substrate 1100 which exhibits the relatively large heat dissipation can be warmed effectively. By this, the ink in the end of the recording element substrate 1100 can also be warmed and the recording operation for the 6 scans (step S402) is carried out in this state. At this time, as described above, since the head temperature reaches about 40° C., the stable ejection can be performed. The temperature is sensed by the head temperature sensor when the recording for the 6 scans (step S402) is finished (step S403). In the case of the head temperature being 40° C. or more, the preliminary ejection (step S409) is carried out and the recording operation for the additional 6 scans is carried out. Since the head temperature is 40° C. or higher, the sufficiently stable ink ejection is possible. In the case of the head temperature being lower than 40° C. in the step S404, the operation advances to the step S405 and starts the energization of the first warming heat generating resistor. The head temperature can be effectively raised by energizing the first warming heat generating resistor in addition to the second warming heat generating resistor. Thereafter, the preliminary ejection (step S406) is carried out, and the recording operation (step S407) for further 6 scans is carried out, and the energization of the first warming heat generating resistor is stopped.

When the step S408 or the step S410 finishes, the discrimination is made about whether all the recording operations are finished in a step S411. If not, the operation returns to the step S403, wherein a preliminary ejection is carried out again. If so, the energization of the second warming heat generating resistor is stopped (step S412), and the operation finishes (step S413).

As described above, more suitable heating can be accomplished by controlling the amount of heat generation of the first warming heat generating resistor and the second warming heat generating resistor in response to the head temperature.

Sixth Embodiment

An ink temperature control processing in this embodiment is performed in the same manner as in Fourth and Fifth Embodiments described above.

Figure 25:
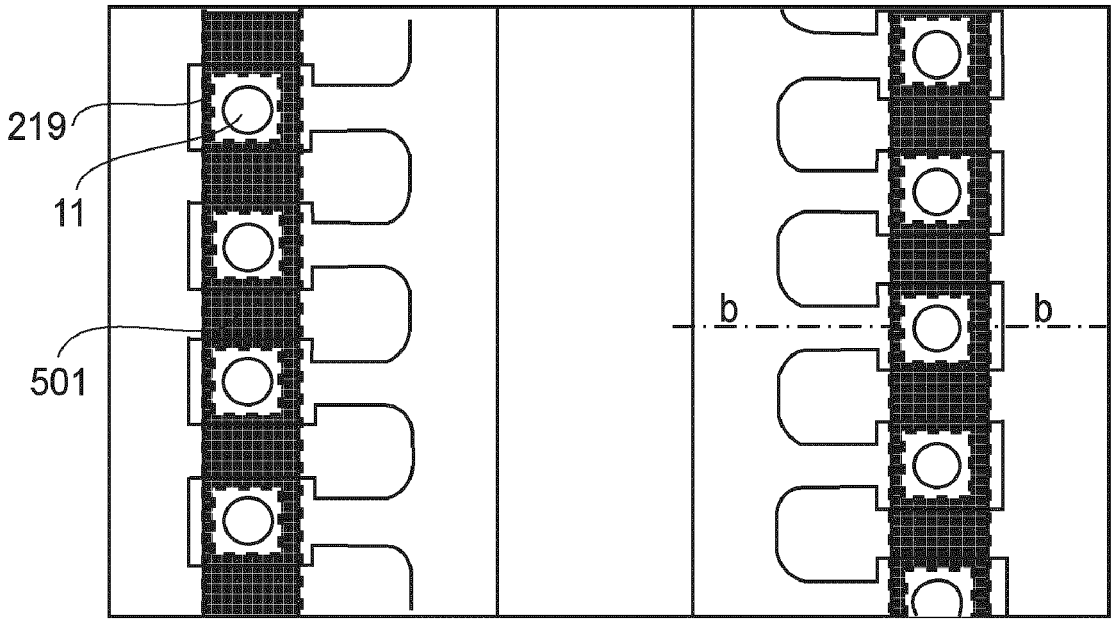
FIG. 25 is an enlarged view of the B portion shown in FIG. 18.
Figure 26:
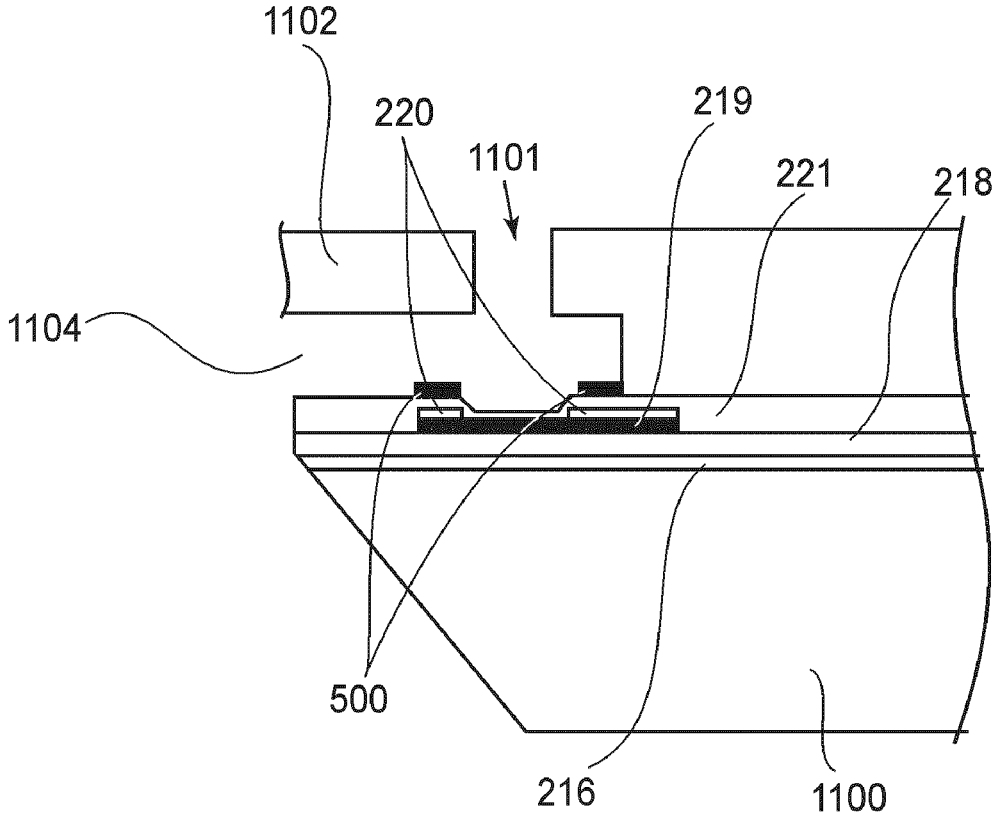
FIG. 26 is a sectional view taken along b-b line shown in FIG. 25.

FIG. 25 is an enlarged plan view of B portion shown in FIG. 18, for illustrating positions of the ink warming heat generating resistors. FIG. 26 is taken along b-b line shown in FIG. 25. As shown in FIG. 25, a part of a first warming heat generating resistor 500 is located at a lower portion of an ink flow path 1104 for supplying the ink to and communicating with an ejection outlet 1101. Further, as shown in FIG. 26, the first warming heat generating resistor extends over and above the ejection heat generating resistor and a part of the first warming heat generating resistor is not formed between the ink flow path and the ejection heat generating resistor. That is, the first warming heat generating resistor 500 is laminated and formed above a recording element substrate 1100 via an ejection heat generating resistor 219 and an insulating layer 218 so that it surrounds an outer periphery of the ejection heat generating resistor 219 when it is perpendicularly projected onto a heat generation surface of the ejection heat generating resistor 219. The warming heat generating resistor is formed in a layer of tantalum simultaneously with formation of a logic circuit (not shown) of the recording element substrate. The tantalum layer surface is oxidized into a layer of $Ta_2O_5$ when it contacts the ink, thus exhibiting a resistance of corrosion by the ink. The tantalum layer is formed on a protecting film by patterning.

Further, as shown in FIG. 26, the first warming heat generating resistor is not formed above the ejection heat generating resistor at an ejection portion, so that bubble generation energy by the ejection heat generating resistor is directly transferred to the ink. Therefore, an ink ejection efficiency can be improved. Further, in FIG. 26, the first warming heat generating resistor is formed by the same wiring so as to extend above and over an ejection heat generating resistor array provided for each other. Further, the first warming heat generating resistor is not formed on the ejection heat generating resistor, so that a resistance value of the first warming heat generating resistor at an overlapping portion as the time when the first warming heat generating resistor is projected onto the ink flow path is increased compared with that at a non-overlapping portion. By this, the heat generation amount of the warming heat generating resistor is increased in the neighborhood of the ejection outlet, so as to efficiently heat the ink in the neighborhood of the ejection outlet.

The ink jet recording head of the present invention is suitably applied to a printer for effecting recording on the recording material, a copying machine, a facsimile machine provided with a communicating system, an apparatus such as a word processor having a recording portion, an industrial recording apparatus combined with various processing apparatuses, and so on. As the recording material, it is possible to use paper, thread, fiber, cloth, leather, metal, plastic, glass, wood, ceramics, etc.

As described above, according to the present invention, in an ink jet recording head with a plurality of ejection amounts, it was possible to suppress a lowering in ejection characteristic of first ink ejection and a lowering in image quality such as streaks or non-uniformity due to a change in color density or color tone. Further, it was possible to realize a stable ejection amount from various ejection outlets from which inks are ejected in different ejection amounts.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application NO. 174295/2007 filed Jul. 2, 2007, which is hereby incorporated by reference.

What is claimed is:

1. An ink jet recording head comprising:

a plurality of ejection heat generating resistors for generating thermal energy for ejecting ink;

a plurality of warming heat generating resistors for generating thermal energy for heating the ink;

a plurality of ejection outlets, provided correspondingly to said plurality of ejection heat generating resistors, for ejecting the ink; and a recording element substrate provided with a plurality of ink flow paths provided correspondingly to said plurality of ejection outlets to supply the ink to said plurality of ejection outlets, said plurality of ejection heat generating resistors, said plurality of warming heat generating resistors, a first ejection outlet array portion including a plurality of said ejection outlets, and a second ejection outlet array portion including a plurality of said ejection outlets, wherein an amount of one ink droplet to be ejected from an ejection outlet of said first ejection outlet array portion is different from an amount of one ink droplet to be ejected from an ejection outlet of said second ejection outlet array portion, wherein said plurality of warming heat generating resistors is formed above said recording element substrate through said plurality of ejection heat generating resistors and an insulating layer with respect to a lamination direction of layers constituting said recording element substrate and is disposed between said plurality of ejection heat generating resistors and the plurality of ink flow paths, and wherein said plurality of warming heat generating resistors comprises a first warming heat generating resistor disposed at said first ejection outlet array portion with a larger ejection amount and a second warming heat generating resistor disposed at the second ejection outlet array portion with a smaller ejection amount.

2. A head according to claim 1, wherein amounts of heat generation of the first warming heat generating resistor and the second warming heat generating resistor are independently controlled.

3. A head according to claim 1, wherein when a head temperature is not more than a predetermined temperature before a recording operation is started, amounts of heat generation of the first warming heat generating resistor and the second warming heat generating resistor are controlled so that the amount of heat generation of the second warming heat generating resistor is equal to or larger than that of the first warming heat generating resistor.

4. A head according to claim 1, wherein amounts of heat generation of the first warming heat generating resistor and the second warming heat generating resistor are controlled so that a minimum temperature of the ink at said first ejection outlet array portion is not more than that at said second ejection outlet array portion during a recording operation.

5. A head according to claim 1, wherein at least one of the first warming heat generating resistor and the second warming heat generating resistor is disposed so as to have a overlapping portion with an associated ejection heat generating resistor when the first warming heat generating resistor and the second warming heat generating resistor are projected onto the associated ejection heat generating resistor with respect to the lamination direction.

6. A head according to claim 1, wherein the first warming heat generating resistor is disposed so as to surround an associated ejection heat generating resistor when the first warming heat generating resistor is projected onto the associated ejection heat generating resistor with respect to the lamination direction.

7. A head according to claim 1, wherein the first warming heat generating resistor and the second warming heat generating resistor are formed by the same wiring for said first ejection outlet array portion and said second ejection outlet array portion, respectively, and wherein when the first warming heat generating resistor and the second warming heat generating resistor are projected onto said recording element substrate with respect to the lamination direction, a resistance value of an overlapping portion with an associated ink flow path is larger than that of a non-overlapping portion with the associated ink flow path.

8. A head according to claim 1, wherein said plurality of warming heat generating resistors is formed in a layer of tantalum.

9. A head according to claim 8, wherein the layer of tantalum has a surface of $Ta_2O_5$.

10. A head according to claim 9, wherein the layer of tantalum is an anti-cavitation layer.

* * * * *